US007845179B2

(12) United States Patent
Singh et al.

(10) Patent No.: US 7,845,179 B2
(45) Date of Patent: Dec. 7, 2010

(54) SYSTEM AND METHOD FOR MONITORING A COMPRESSOR OF A REFRIGERATION SYSTEM

(75) Inventors: Abtar Singh, Kennesaw, GA (US); Thomas J. Matthews, Fayette, ME (US); Stephen T. Woodworth, Woodstock, GA (US)

(73) Assignee: Emerson Retail Services, Inc., Kennesaw, GA (US)

( * ) Notice: Subject to any disclaimer, the term of this patent is extended or adjusted under 35 U.S.C. 154(b) by 0 days.

(21) Appl. No.: 12/327,273

(22) Filed: Dec. 3, 2008

(65) Prior Publication Data

US 2009/0077983 A1 Mar. 26, 2009

Related U.S. Application Data

(63) Continuation of application No. 10/833,259, filed on Apr. 27, 2004, now Pat. No. 7,490,477.

(60) Provisional application No. 60/466,637, filed on Apr. 30, 2003.

(51) Int. Cl.
*F25B 49/00* (2006.01)

(52) U.S. Cl. ..... 62/129; 62/217; 62/225

(58) Field of Classification Search ..... 62/126, 62/129, 157, 217, 225, 125, 228.3
See application file for complete search history.

(56) References Cited

U.S. PATENT DOCUMENTS 4,325,223 A 4/1982 Cantley
4,510,576 A 4/1985 MacArthur et al.
4,611,470 A 9/1986 Enstrom
4,768,346 A 9/1988 Mathur
4,841,734 A 6/1989 Torrence
4,939,909 A 7/1990 Tsuchiyama et al.

(Continued)

FOREIGN PATENT DOCUMENTS

EP 1 187 021 A2 3/2002

(Continued)

OTHER PUBLICATIONS

First Office Action received from the Chinese Patent Office dated Feb. 2, 2007 regarding Application No. 200480011463.2, translated by CCPIT Patent and Trademark Law Office.

(Continued)

*Primary Examiner*—Marc E Norman
(74) *Attorney, Agent, or Firm*—Harness, Dickey & Pierce, P.L.C.

(57) ABSTRACT

A system includes a compressor temperature sensor that generates a compressor discharge temperature signal corresponding to a compressor of a refrigeration system, a compressor pressure sensor that generates a compressor discharge pressure signal corresponding to the compressor, and a controller processing the signals over a predetermined time period. The processing includes calculating a discharge saturation temperature based on the compressor discharge pressure signal, calculating compressor superheat data based on the compressor discharge temperature signal and the discharge saturation temperature, accumulating the compressor superheat data over the predetermined time period, and comparing the accumulated compressor superheat data to a predetermined threshold. The controller generates an alarm indicating a compressor fault based on the comparing.

14 Claims, 24 Drawing Sheets

U.S. PATENT DOCUMENTS

| | | | | |
|---|---|---|---|---|
| 5,181,389 | A | | 1/1993 | Hanson et al. |
| 5,209,076 | A | | 5/1993 | Kauffman et al. |
| 5,369,958 | A | * | 12/1994 | Kasai et al. ..... 62/158 |
| 5,460,006 | A | | 10/1995 | Torimitsu |
| 5,555,195 | A | | 9/1996 | Jensen et al. |
| 5,586,446 | A | | 12/1996 | Torimitsu |
| 5,875,430 | A | | 2/1999 | Koether |
| 5,946,922 | A | | 9/1999 | Viard et al. |
| 6,215,405 | B1 | | 4/2001 | Handley et al. |
| 6,393,848 | B2 | | 5/2002 | Roh et al. |
| 6,397,606 | B1 | | 6/2002 | Roh et al. |
| 6,549,135 | B2 | | 4/2003 | Singh et al. |
| 6,609,078 | B2 | | 8/2003 | Starling et al. |
| 2001/0054291 | A1 | | 12/2001 | Roh et al. |
| 2002/0000092 | A1 | | 1/2002 | Sharood et al. |
| 2002/0029575 | A1 | | 3/2002 | Okamoto |
| 2002/0082924 | A1 | | 6/2002 | Koether |
| 2002/0161545 | A1 | | 10/2002 | Starling et al. |
| 2003/0077179 | A1 | * | 4/2003 | Collins et al. ..... 417/63 |

FOREIGN PATENT DOCUMENTS

| | | |
|---|---|---|
| JP | 62-116844 | 5/1987 |
| WO | WO 02/14968 A1 | 2/2002 |

OTHER PUBLICATIONS

Second Office Action received from the Chinese Patent Office dated Jun. 26, 2009 regarding Application No. 200480011463.2, translated by CCPIT Patent and Trademark Law Office.

International Search Report, International Application No. PCT/US04/13384; dated Aug. 1, 2004; 1 page.

Examination Report received from Australian Government IP Australia dated Oct. 29, 2009 regarding patent application No. 2008202088.

* cited by examiner

| Band | Lower Limit | Upper Limit |
|---|---|---|
| 1 | PP | >PP |
| 2 | P | PP |
| 3 | Z | P |
| 4 | M | Z |
| 5 | MM | M |
| 6 | <MM | MM |
| 7 | Z | PP |
| 8 | MM | Z |
| 9 | P | >PP |
| 10 | M | P |
| 11 | <MM | M |
| 12 | MM | PP |
| 13 | Z | >PP |
| 14 | <MM | Z |

SYSTEM AND METHOD FOR MONITORING A COMPRESSOR OF A REFRIGERATION SYSTEM

CROSS-REFERENCE TO RELATED APPLICATIONS

This application is a continuation of U.S. application Ser. No. 10/833,259, filed on Apr. 27, 2004, which claims the benefit of U.S. Provisional Application No. 60/466,637, filed on Apr. 30, 2003. The disclosures of the above applications are incorporated herein by reference.

FIELD

The present disclosure relates to refrigeration systems and more particularly to a system and method for monitoring a compressor of a refrigeration system.

BACKGROUND

Produced food travels from processing plants to retailers, where the food product remains on display case shelves for extended periods of time. In general, the display case shelves are part of a refrigeration system for storing the food product. In the interest of efficiency, retailers attempt to maximize the shelf-life of the stored food product while maintaining awareness of food product quality and safety issues.

The refrigeration system plays a key role in controlling the quality and safety of the food product. Thus, any breakdown in the refrigeration system or variation in performance of the refrigeration system can cause food quality and safety issues. Thus, it is important for the retailer to monitor and maintain the equipment of the refrigeration system to ensure its operation at expected levels.

Refrigeration systems generally require a significant amount of energy to operate. The energy requirements are thus a significant cost to food product retailers, especially when compounding the energy uses across multiple retail locations. As a result, it is in the best interest of food retailers to closely monitor the performance of the refrigeration systems to maximize their efficiency, thereby reducing operational costs.

Monitoring refrigeration system performance, maintenance and energy consumption are tedious and time-consuming operations and are undesirable for retailers to perform independently. Generally speaking, retailers lack the expertise to accurately analyze time and temperature data and relate that data to food product quality and safety, as well as the expertise to monitor the refrigeration system for performance, maintenance and efficiency. Further, a typical food retailer includes a plurality of retail locations spanning a large area. Monitoring each of the retail locations on an individual basis is inefficient and often results in redundancies.

SUMMARY

This section provides a general summary of the disclosure, and is not a comprehensive disclosure of its full scope or all of its features.

A system is provided including a compressor temperature sensor that generates a compressor discharge temperature signal corresponding to a compressor of a refrigeration system, a compressor pressure sensor that generates a compressor discharge pressure signal corresponding to the compressor, and a controller. The controller processes the signals over a predetermined time period. The processing includes calculating a discharge saturation temperature based on the compressor discharge pressure signal, calculating compressor superheat data based on the compressor discharge temperature signal and the discharge saturation temperature, accumulating the compressor superheat data over the predetermined time period, and comparing the accumulated compressor superheat data to a predetermined threshold. The controller generates an alarm indicating a compressor fault based on the comparing.

In other features, the processing of the signals includes determining whether each of the signals is within a useful range, determining whether each of the signals is dynamic and determining whether each of the signals is valid.

In other features, the controller communicates the alarm over a communication network to a remote processing center.

In other features, the controller determines an occurrence of a floodback event based on the compressor discharge temperature signal and the compressor discharge pressure signal and notifies a remote processing center of the floodback event.

In other features, the controller observes a pattern of the compressor superheat data to determine whether the floodback event has occurred.

In other features, the controller accumulates compressor superheat data for each compressor of a plurality of compressors positioned with any compressor rack, compares the accumulated compressor superheat data for each compressor, and generates an alarm indicating a compressor fault for each compressor positioned within the compressor rack based on the comparing.

In other features, the controller determines a plurality of bands that define ranges associated with each of the signals and populates each band based on values of the signals that are observed over the predetermined time period.

In other features, the alarm is generated when a population of a particular band exceeds a threshold associated with the particular band.

A method is also disclosed that includes generating a compressor discharge temperature signal with a compressor temperature sensor corresponding to a compressor of a refrigeration system, generating a compressor discharge pressure signal with a compressor pressure sensor corresponding to the compressor, and processing the signals over a predetermined time period. The processing includes calculating a discharge saturation temperature based on the compressor discharge pressure signal, calculating compressor superheat data based on the compressor discharge temperature signal and the discharge saturation temperature, accumulating the compressor superheat data over the predetermined time period, and comparing the accumulated compressor superheat data to a predetermined threshold. The method also includes generating an alarm indicating a compressor fault based on the comparing.

In other features, the method also includes determining whether each of the signals is within a useful range, determining whether each of the signals is dynamic and determining whether each of the signals.

In other features, the method also includes communicating the alarm over a communication network to a remote processing center.

In other features, the method also includes determining an occurrence of a floodback event based on the compressor discharge temperature signal and the compressor discharge pressure signal and notifying a remote processing center of the floodback event.

In other features, the method also includes observing a pattern of the compressor superheat data to determine whether the floodback event has occurred.

In other features, the method also includes accumulating compressor superheat data for each compressor of a plurality of compressors positioned within a compressor rack, comparing the accumulated compressor superheat data for each compressor, and generating an alarm indicating a compressor fault for each compressor positioned within the compressor rack based on the comparing.

In other features, the method also includes determining a plurality of bands that define ranges associated with each of the signals and populating each band based on the values of the signals that are observed over the predetermined time period.

In other features, the method also includes generating the alarm when a population of a particular band exceeds a threshold associated with that particular band.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and are not all possible implementations, and are not intended to limit the scope of the present disclosure:

DETAILED DESCRIPTION

Example embodiments will now be described more fully with reference to the accompanying drawings. The following description is exemplary in nature and is in no way intended to limit the invention, its application, or uses.

Figure 1:
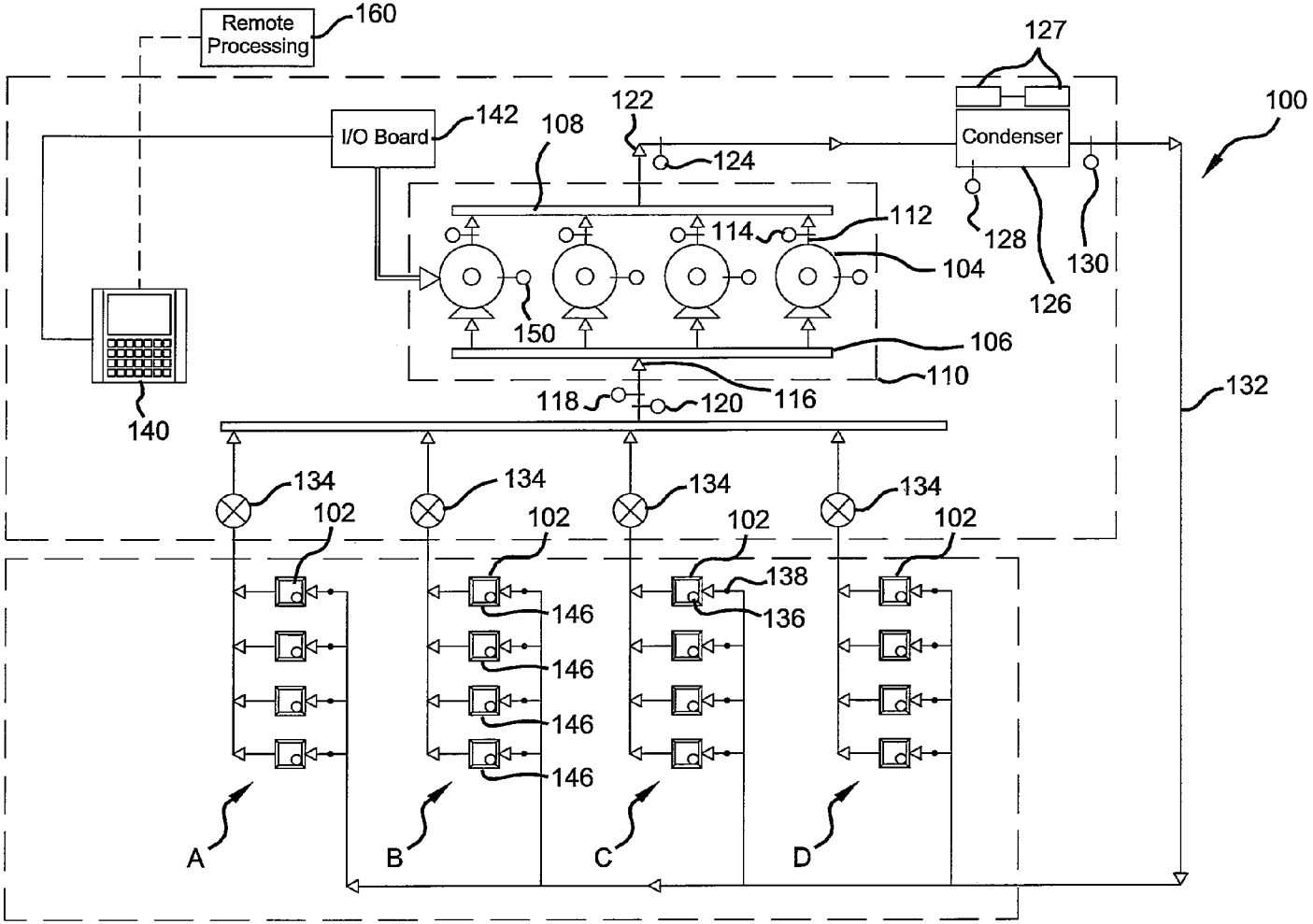
FIG. 1 is a schematic illustration of an exemplary refrigeration system.

With reference to FIG. 1, an exemplary refrigeration system 100 includes a plurality of refrigerated food storage cases 102. The refrigeration system 100 includes a plurality of compressors 104 piped together with a common suction manifold 106 and a discharge header 108 all positioned within a compressor rack 110. A discharge output 112 of each compressor 104 includes a respective temperature sensor 114. An input 116 to the suction manifold 106 includes both a pressure sensor 118 and a temperature sensor 120. Further, a discharge outlet 122 of the discharge header 108 includes an associated pressure sensor 124. As described in further detail hereinbelow, the various sensors are implemented for evaluating maintenance requirements.

The compressor rack 110 compresses refrigerant vapor that is delivered to a condenser 126 where the refrigerant vapor is liquefied at high pressure. Condenser fans 127 are associated with the condenser 126 to enable improved heat transfer from the condenser 126. The condenser 126 includes an associated ambient temperature sensor 128 and an outlet pressure sensor 130. This high-pressure liquid refrigerant is delivered to the plurality of refrigeration cases 102 by way of piping 132. Each refrigeration case 102 is arranged in separate circuits consisting of a plurality of refrigeration cases 102 that operate within a certain temperature range. FIG. 1 illustrates four (4) circuits labeled circuit A, circuit B, circuit C and circuit D. Each circuit is shown consisting of four (4) refrigeration cases 102. However, those skilled in the art will recognize that any number of circuits, as well as any number of refrigeration cases 102 may be employed within a circuit. As indicated, each circuit will generally operate within a certain temperature range. For example, circuit A may be for frozen food, circuit B may be for dairy, circuit C may be for meat, etc.

Because the temperature requirement is different for each circuit, each circuit includes a pressure regulator 134 that acts to control the evaporator pressure and, hence, the temperature of the refrigerated space in the refrigeration cases 102. The pressure regulators 134 can be electronically or mechanically controlled. Each refrigeration case 102 also includes its own evaporator 136 and its own expansion valve 138 that may be either a mechanical or an electronic valve for controlling the superheat of the refrigerant. In this regard, refrigerant is delivered by piping to the evaporator 136 in each refrigeration case 102.

The refrigerant passes through the expansion valve 138 where a pressure drop causes the high pressure liquid refrigerant to achieve a lower pressure combination of liquid and vapor. As hot air from the refrigeration case 102 moves across the evaporator 136, the low pressure liquid turns into gas. This low pressure gas is delivered to the pressure regulator 134 associated with that particular circuit. At the pressure regulator 134, the pressure is dropped as the gas returns to the compressor rack 110. At the compressor rack 110, the low pressure gas is again compressed to a high pressure gas, which is delivered to the condenser 126, which creates a high pressure liquid to supply to the expansion valve 138 and start the refrigeration cycle again.

A main refrigeration controller 140 is used and configured or programmed to control the operation of the refrigeration system 100. The refrigeration controller 140 is preferably an Einstein Area Controller offered by CPC, Inc. of Atlanta, Ga., or any other type of programmable controller that may be programmed, as discussed herein. The refrigeration controller 140 controls the bank of compressors 104 in the compressor rack 110, via an input/output module 142. The input/output module 142 has relay switches to turn the compressors 104 on an off to provide the desired suction pressure.

A separate case controller (not shown), such as a CC-100 case controller, also offered by CPC, Inc. of Atlanta, Ga. may be used to control the superheat of the refrigerant to each refrigeration case 102, via an electronic expansion valve in each refrigeration case 102 by way of a communication network or bus. Alternatively, a mechanical expansion valve may be used in place of the separate case controller. Should separate case controllers be utilized, the main refrigeration controller 140 may be used to configure each separate case controller, also via the communication bus. The communication bus may either be a RS-485 communication bus or a LonWorks Echelon bus that enables the main refrigeration controller 140 and the separate case controllers to receive information from each refrigeration case 102.

Each refrigeration case 102 may have a temperature sensor 146 associated therewith, as shown for circuit B. The temperature sensor 146 can be electronically or wirelessly connected to the controller 140 or the expansion valve for the refrigeration case 102. Each refrigeration case 102 in the circuit B may have a separate temperature sensor 146 to take average/min/max temperatures or a single temperature sensor 146 in one refrigeration case 102 within circuit B may be used to control each refrigeration case 102 in circuit B because all of the refrigeration cases 102 in a given circuit operate at substantially the same temperature range. These temperature inputs are preferably provided to the analog input board 142, which returns the information to the main refrigeration controller 140 via the communication bus.

Additionally, further sensors are provided and correspond with each component of the refrigeration system and are in communication with the refrigeration controller 140. Energy sensors 150 are associated with the compressors 104 and the condenser 126 of the refrigeration system 100. The energy sensors 150 monitor energy consumption of their respective components and relay that information to the controller 140.

Figure 2:
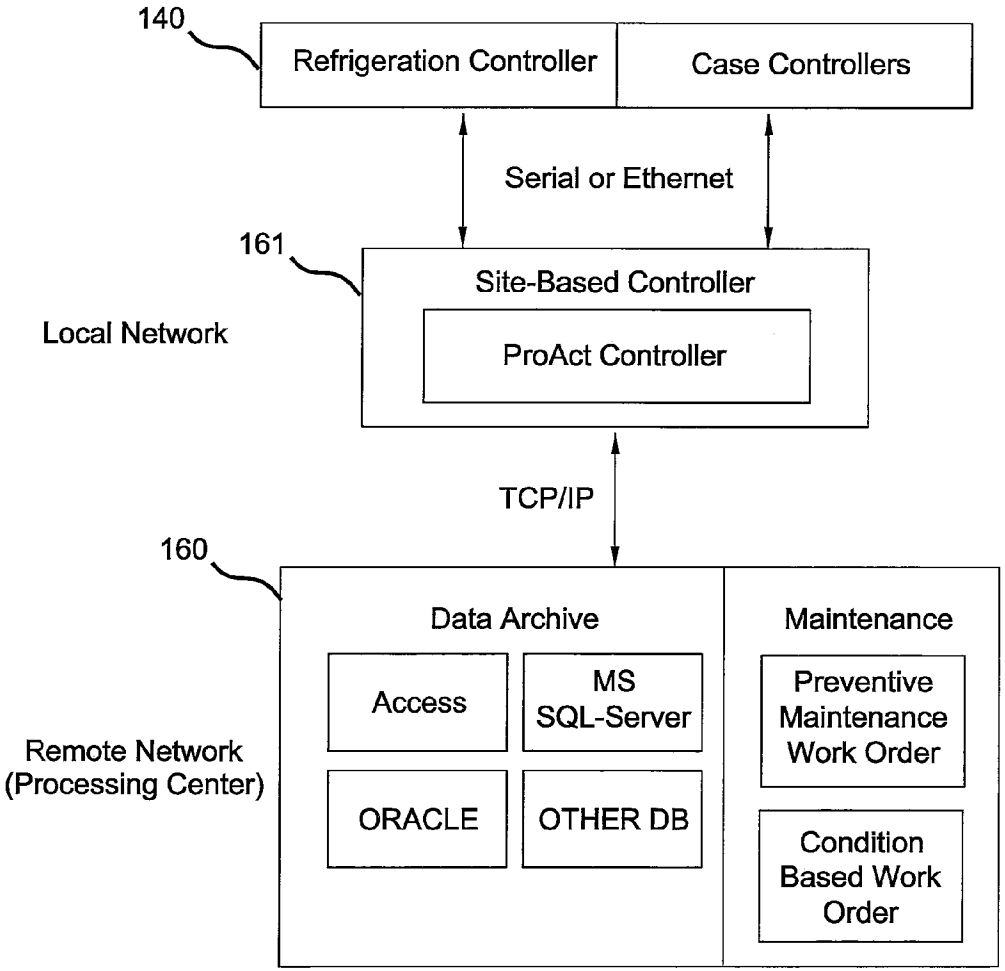
FIG. 2 is a schematic overview of a system for remotely monitoring and evaluating a remote location.

Referring now to FIG. 2, the refrigeration controller 140 and case controllers communicates with a remote network or processing center 160. It is anticipated that the remote processing center 160 can be either in the same location (e.g. food product retailer) as the refrigeration system 100 or can be a centralized processing center that monitors the refrigeration systems of several remote locations. The refrigeration controller 140 and case controllers initially communicate with a site-based controller 161 via a serial connection or Ethernet. The site-based controller 161 communicates with the processing center 160 via a TCP/IP connection.

The processing center 160 collects data from the refrigeration controller 140, the case controllers and the various sensors associated with the refrigeration system 100. For example, the processing center 160 collects information such as compressor, flow regulator and expansion valve set points from the refrigeration controller 140. Data such as pressure and temperature values at various points along the refrigeration circuit are provided by the various sensors via the refrigeration controller 140. More specifically, the software system is a multi-tiered system spanning all three hardware levels. At the local level (i.e., refrigeration controller and case controllers) is the existing controller software and raw I/O data collection and conversion.

A controller database and the ProAct CB algorithms reside on the site-based controller 161. The algorithms manipulate the controller data generating notices, service recommendations, and alarms based on pattern recognition and fuzzy logic. Finally, this algorithm output (alarms, notices, etc.) is served to a remote network workstation at the processing center 160, where the actual service calls are dispatched and alarms managed. The refined data is archived for future analysis and customer access at a client-dedicated website.

Figure 3:
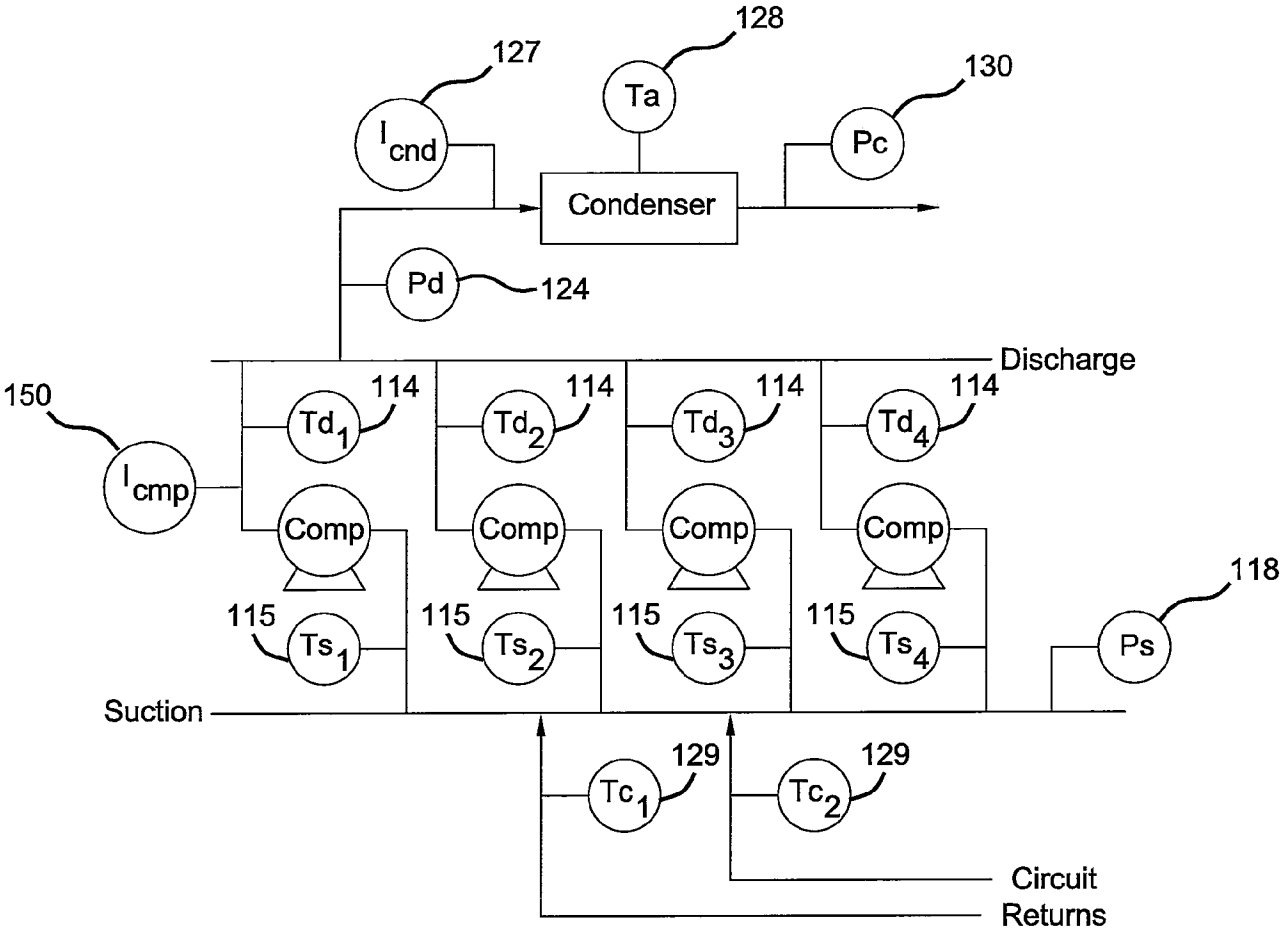
FIG. 3 is a simplified schematic illustration of circuit piping of the refrigeration system of FIG. 1 illustrating measurement sensors.
Figure 4:
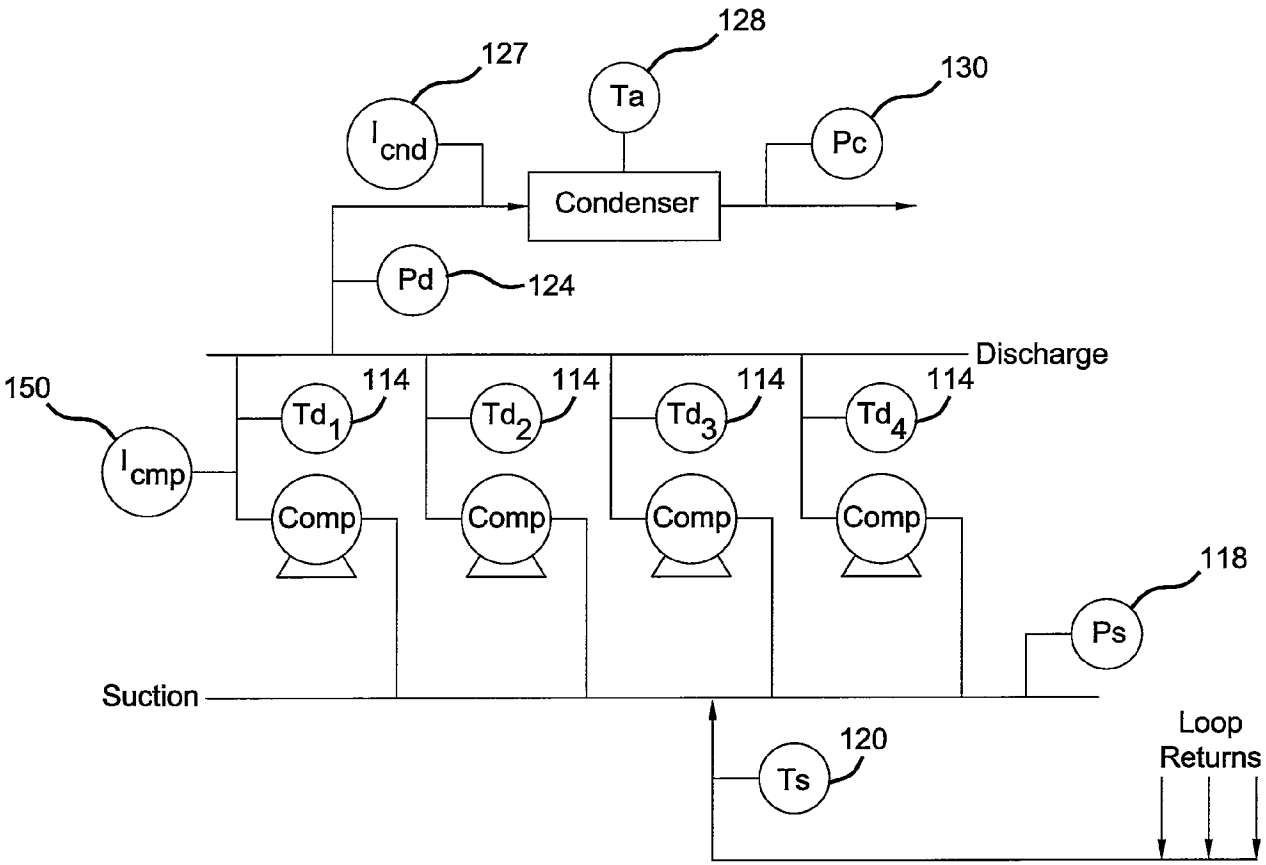
FIG. 4 is a simplified schematic illustration of loop piping of the refrigeration system of FIG. 1 illustrating measurement sensors.

Referring now to FIGS. 3 and 4, for each refrigeration circuit and loop of the refrigeration system 100, several calculations are required to calculate superheat, saturation properties and other values used in the herein described algorithms. These measurements include: ambient temperature ($T_a$), discharge pressure ($P_d$), condenser pressure ($P_c$), suction temperature ($T_s$), suction pressure ($P_s$), refrigeration level ($L_{REF}$), compressor discharge temperature ($T_d$), rack current load ($I_{cmp}$), condenser current load ($I_{cnd}$) and compressor run status. Other accessible controller parameters will be used as necessary. Foe example, a power sensor can monitor the power consumption of the compressor racks and the condenser. Besides the sensors described above, suction temperature sensors 115 monitor $T_s$ of the individual compressors 104 in a rack and a rack current sensor 150 monitors $I_{cmp}$ of a rack. The pressure sensor 124 monitors $P_d$ and a current sensor 127 monitors $I_{cnd}$. Multiple temperature sensors 129 monitor a return temperature ($T_c$) for each circuit.

The present invention provides control and evaluation algorithms in the form of software modules to predict maintenance requirements for the various components in the refrigeration system 100. These algorithms include signal conversion and validation, saturated refrigerant properties, watchdog message, recurring notice or alarm message, floodback alert, contactor cycling count, compressor performance, condenser performance, defrost abnormality, case discharge versus product temperature, data pattern recognition, condenser discharge temperature and loss of refrigerant charge. Each is discussed in detail below. The algorithms can be processed locally using the refrigeration controller 140 or remotely at the remote processing center 160.

Figure 5:
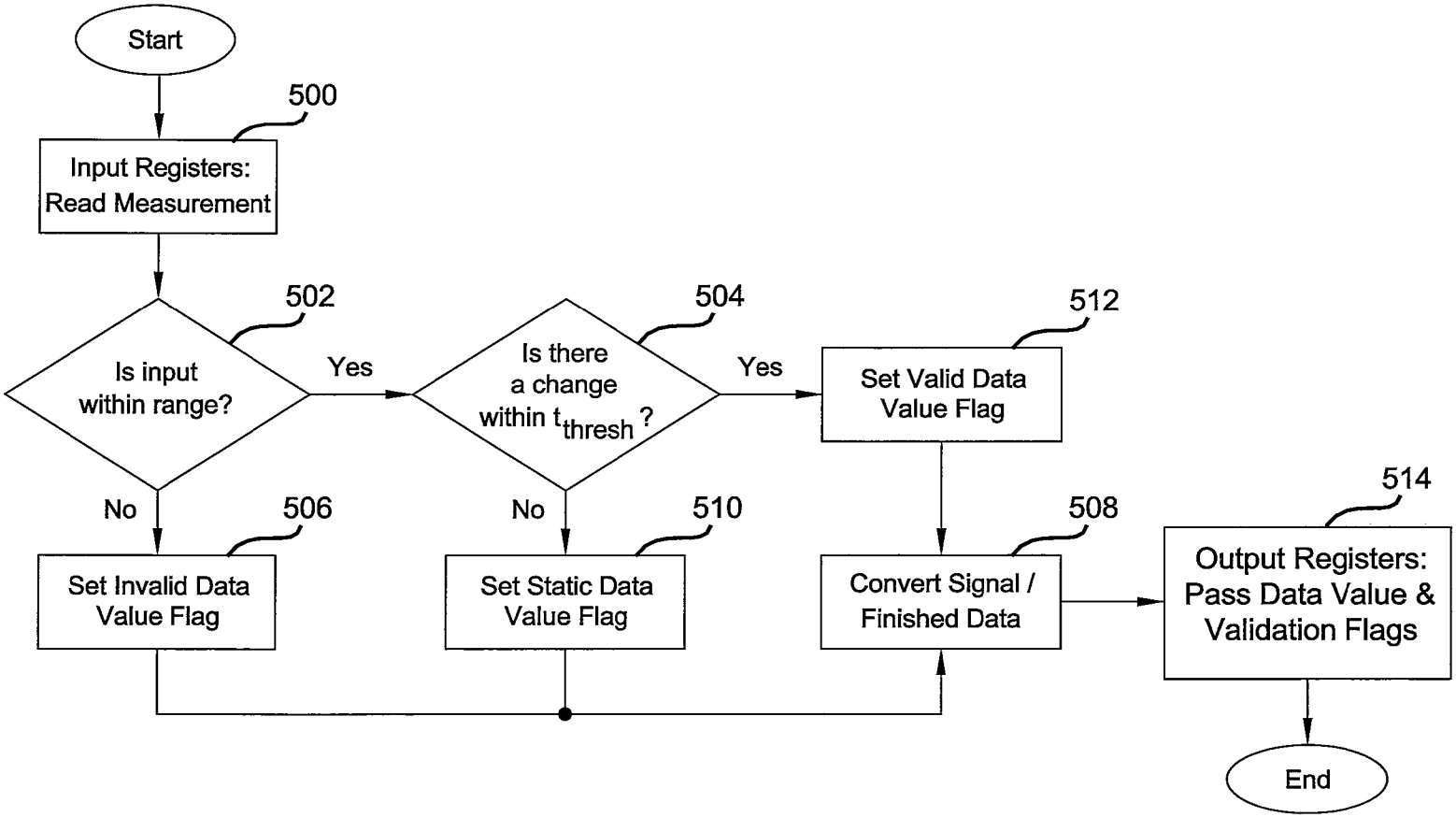
FIG. 5 is a flowchart illustrating a signal conversion and validation algorithm according to the present invention.

Referring now to FIG. 5, a signal conversion and validation (SCV) algorithm processes measurement signals from the various sensors. The SCV algorithm determines the value of a particular signal and up to three different qualities including whether the signal is within a useful range, whether the signal changes over time and/or whether the actual input signal from the sensor is valid.

In step 500, the input registers read the measurement signal of a particular sensor. In step 502, it is determined whether the input signal is within a range that is particular to the type of measurement. If the input signal is within range, the SCV algorithm continues in step 504. If the input signal is not within the range an invalid data range flag is set in step 506 and the SCV algorithm continues in step 508. In step 504, it is determined whether there is a change (Δ) in the signal within a threshold time ($t_{thresh}$). If there is no change in the signal it is deemed static. In this case, a static data value flag is set in step 510 and the SCV algorithm continues in step 508. If there is a change in the signal a valid data value flag is set in step 512 and the SCV algorithm continues in step 508.

In step 508, the signal is converted to provide finished data. More particularly, the signal is generally provided as a voltage. The voltage corresponds to a particular value (e.g., temperature, pressure, current, etc.). Generally, the signal is converted by multiplying the voltage value by a conversion constant (e.g., ° C./V, kPa/V, A/V, etc.). In step 514, the output registers pass the data value and validation flags and control ends.

Figure 6:
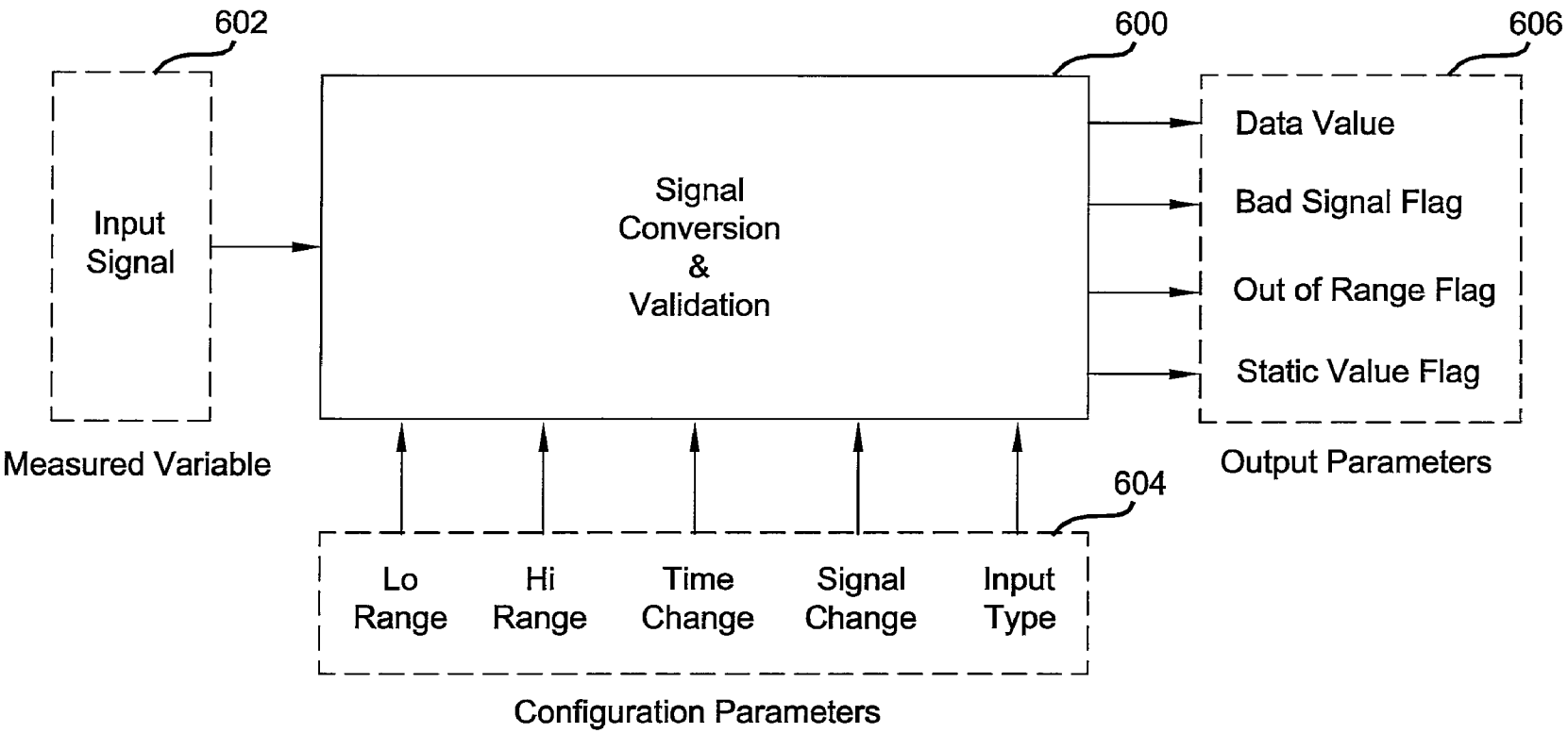
FIG. 6 is a block diagram illustrating configuration and output parameters for the signal conversion and validation algorithm of FIG. 5.

Referring now to FIG. 6, a block diagram schematically illustrates an SCV block 600. A measured variable 602 is shown as the input signal. The input signal is provided by the instruments or sensors. Configuration parameters 604 are provided and include Lo and Hi range values, a time A, a signal Δ and an input type. The configuration parameters 604 are specific to each signal and each application. Output parameters 606 are output by the SCV block 600 and include the data value, bad signal flag, out of range flag and static value flag. In other words, the output parameters 606 are the finished data and data quality parameters associated with the measured variable.

Referring now to FIGS. 7 through 10, refrigeration property algorithms will be described in detail. The refrigeration property algorithms provide the saturation pressure ($P_{SAT}$), density and enthalpy based on temperature. The refrigeration property algorithms further provide saturation temperature ($T_{SAT}$) based on pressure. Each algorithm incorporates thermal property curves for common refrigerant types including, but not limited to, R22, R401a (MP39), R402a (HP80), R404a (HP62), R409a and R507c.

Figure 7:
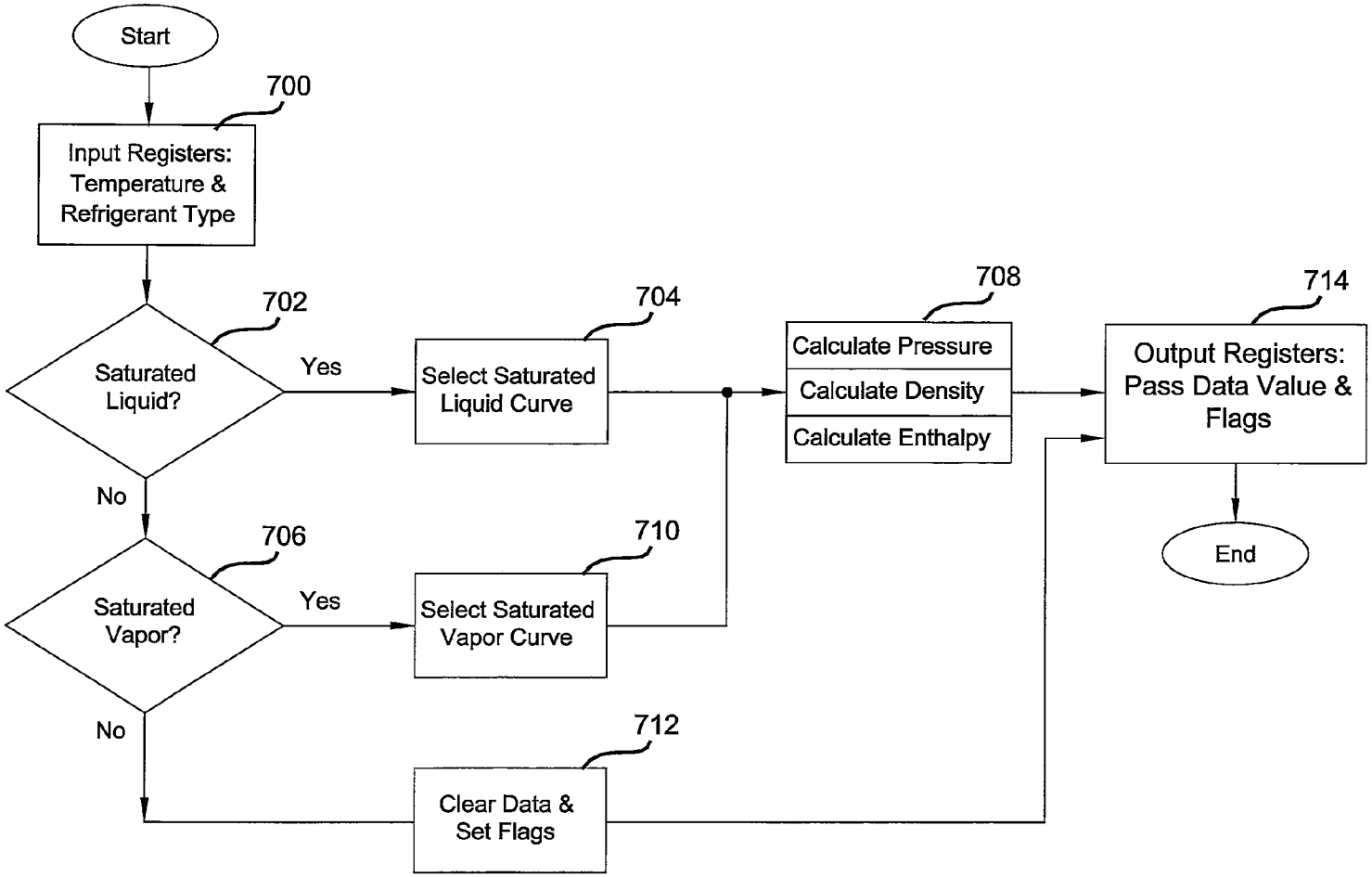
FIG. 7 is a flowchart illustrating a refrigerant properties from temperature (RPFT) algorithm.

With particular reference to FIG. 7 a refrigerant properties from temperature (RPFT) algorithm is shown. In step 700, the temperature and refrigerant type are input. In step 702, it is determined whether the refrigerant is saturated liquid based on the temperature. If the refrigerant is in the saturated liquid state, the RPFT algorithm continues in step 704. If the refrigerant is not in the saturated liquid state, the RPFT algorithm continues in step 706. In step 704, the RPFT algorithm selects the saturated liquid curve from the thermal property curves for the particular refrigerant type and continues in step 708.

In step 706, it is determined whether the refrigerant is in a saturated vapor state. If the refrigerant is in the saturated vapor state, the RPFT algorithm continues in step 710. If the refrigerant is not in the saturated vapor state, the RPFT algorithm continues in step 712. In step 712, the data values are cleared, flags are set and the RPFT algorithm continues in step 714. In step 710, the RPFT algorithm selects the saturated vapor curve from the thermal property curves for the particular refrigerant type and continues in step 708. In step 708, data values for the refrigerant are determined. The data values include pressure, density and enthalpy. In step 714, the RPFT algorithm outputs the data values and flags.

Figure 8:
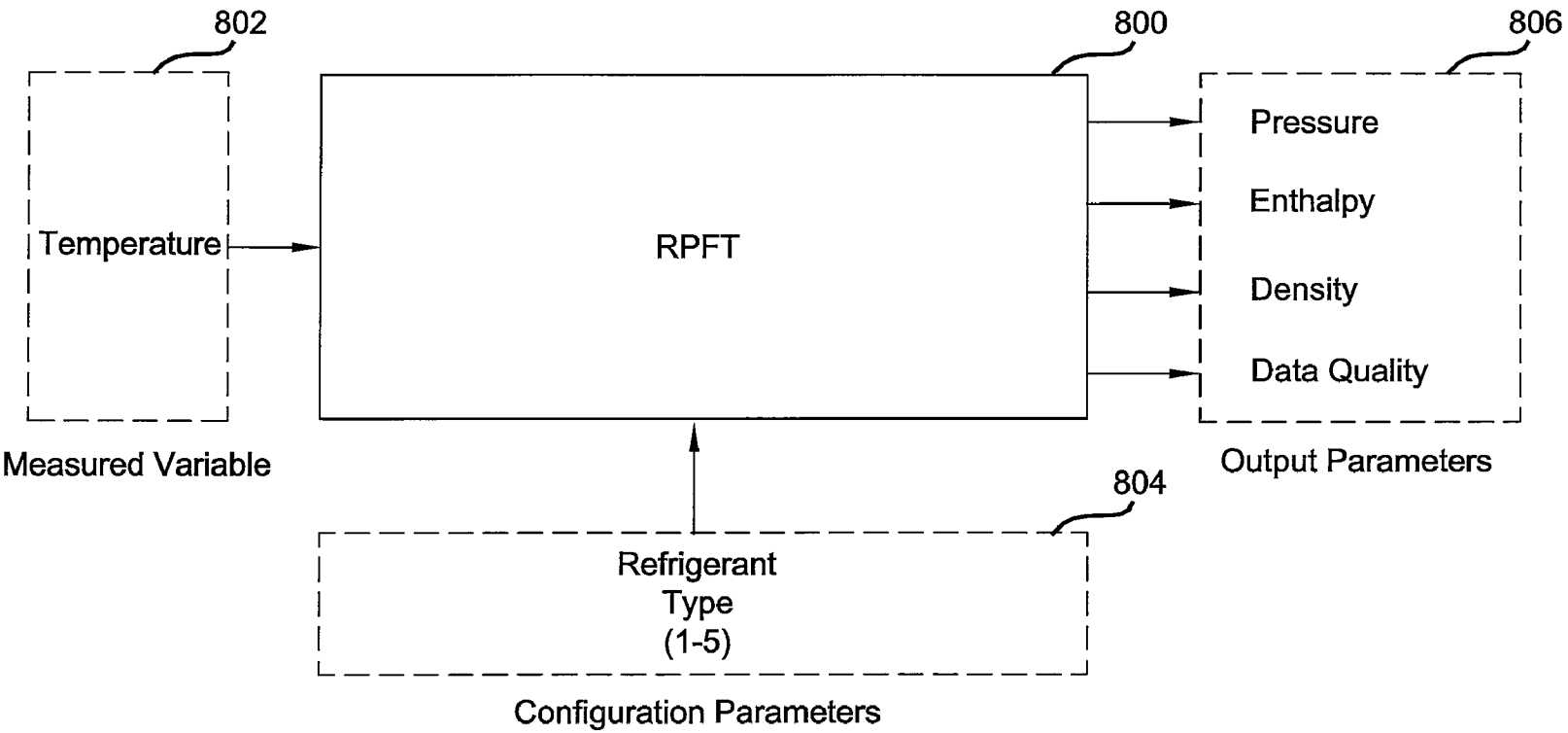
FIG. 8 is a block diagram illustrating configuration and output parameters for the RPFT algorithm.

Referring now to FIG. 8, a block diagram schematically illustrates an RPFT block 800. A measured variable 802 is shown as the temperature. The temperature is provided by the instruments or sensors. Configuration parameters 804 are provided and include the particular refrigerant type. Output parameters 806 are output by the RPFT block 800 and include the pressure, enthalpy, density and data quality flag.

Figure 9:
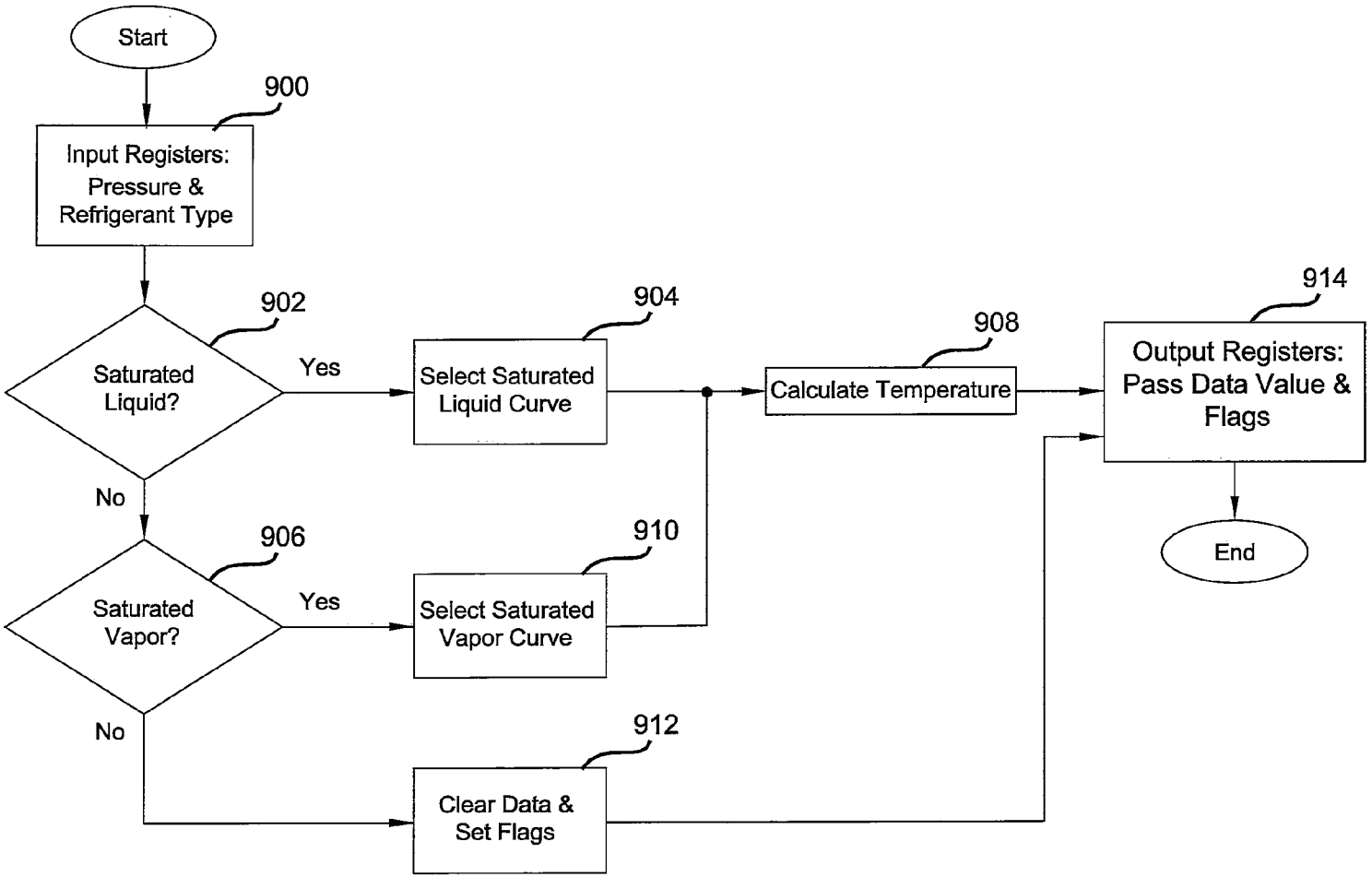
FIG. 9 is a flowchart illustrating a refrigerant properties from pressure (RPFP) algorithm.

With particular reference to FIG. 9 a refrigerant properties from pressure (RPFP) algorithm is shown. In step 900, the temperature and refrigerant type are input. In step 902, it is determined whether the refrigerant is saturated liquid based on the pressure. If the refrigerant is in the saturated liquid state, the RPFP algorithm continues in step 904. If the refrigerant is not in the saturated liquid state, the RPFP algorithm continues in step 906. In step 904, the RPFP algorithm selects the saturated liquid curve from the thermal property curves for the particular refrigerant type and continues in step 908.

In step 906, it is determined whether the refrigerant is in a saturated vapor state. If the refrigerant is in the saturated vapor state, the RPFP algorithm continues in step 910. If the refrigerant is not in the saturated vapor state, the RPFP algorithm continues in step 912. In step 912, the data values are cleared, flags are set and the RPFP algorithm continues in step 914. In step 910, the RPFP algorithm selects the saturated vapor curve from the thermal property curves for the particular refrigerant type and continues in step 908. In step 908, the temperature of the refrigerant is determined. In step 914, the RPFP algorithm outputs the temperature and flags.

Figure 10:
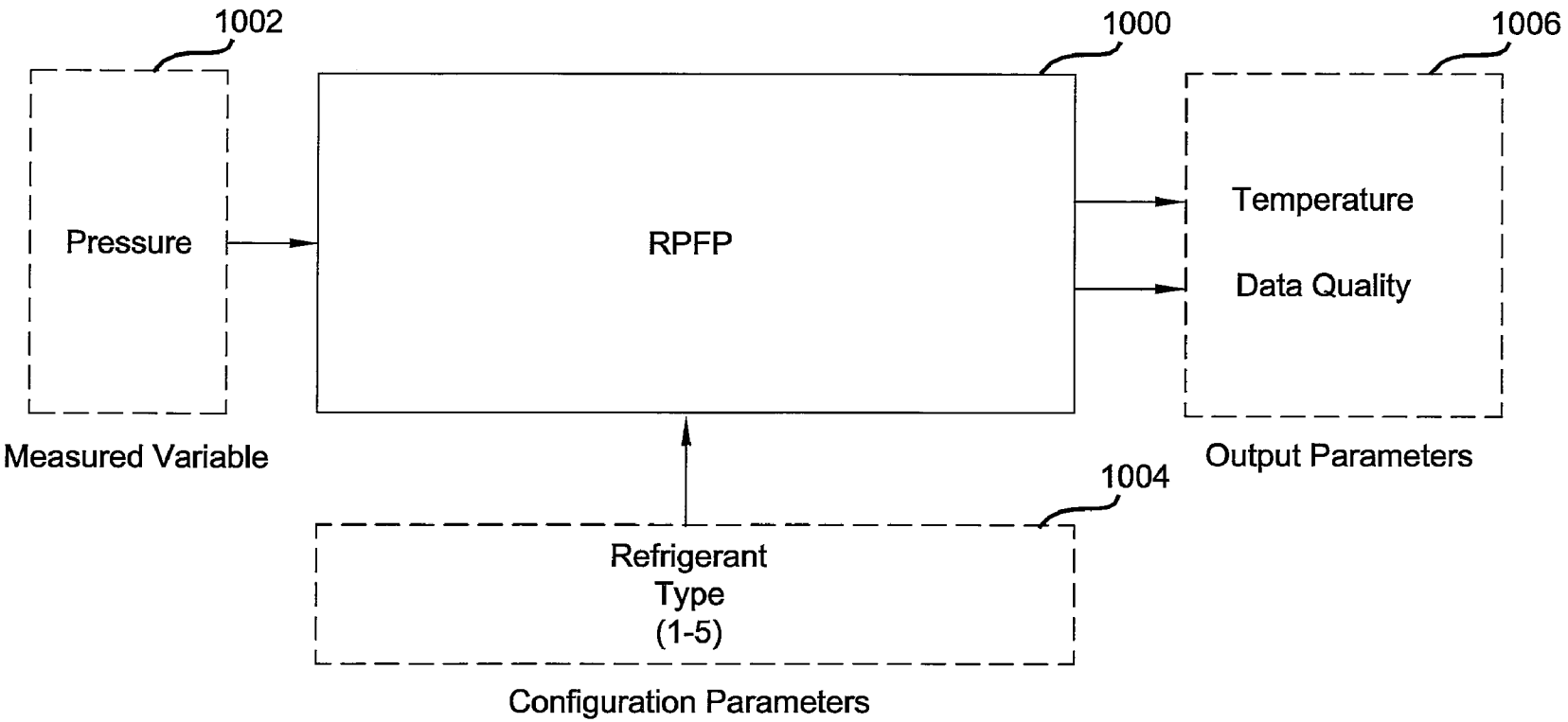
FIG. 10 is a block diagram illustrating configuration and output parameters for the RPFP algorithm.

Referring now to FIG. 10, a block diagram schematically illustrates an RPFP block 1000. A measured variable 1002 is shown as the pressure. The pressure is provided by the instruments or sensors. Configuration parameters 1004 are provided and include the particular refrigerant type. Output parameters 1006 are output by the RPFP block 1000 and include the temperature and data quality flag.

Figure 11:
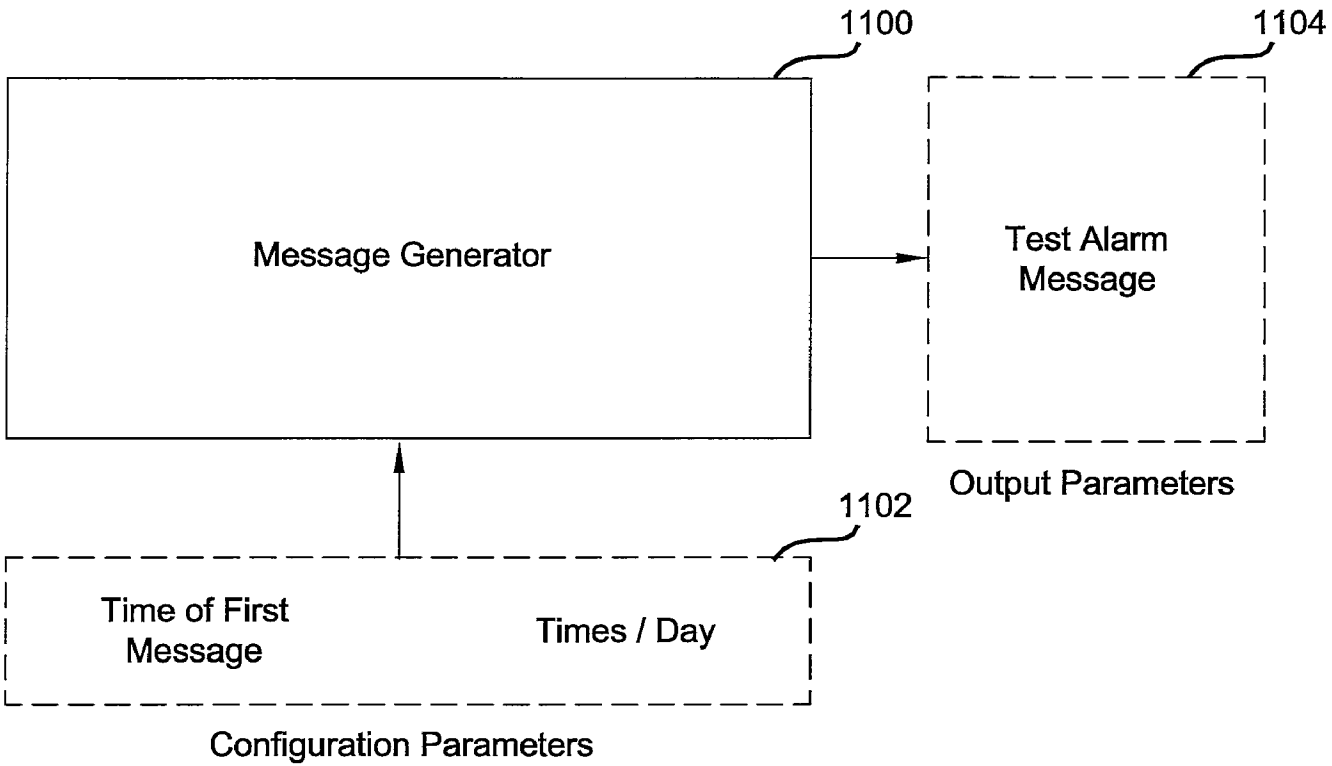
FIG. 11 is a block diagram illustrating configuration and output parameters of a watchdog message algorithm.

Referring now to FIG. 11, a block diagram schematically illustrates the watchdog message algorithm, which includes a message generator 1100, configuration parameters 1102 and output parameters 1104. In accordance with the watchdog message algorithm, the site-based controller 161 periodically reports its health (i.e., operating condition) to the remainder of the network. The site-based controller generates a test message that is periodically broadcast. The time and frequency of the message is configured by setting the time of the first message and the number of times per day the test message is to be broadcast. Other components of the network (e.g., the refrigeration controller 140, the processing center 160 and the case controllers) periodically receive the test message. If the test message is not received by one or more of the other network components, a controller communication fault is indicated.

Figure 12:
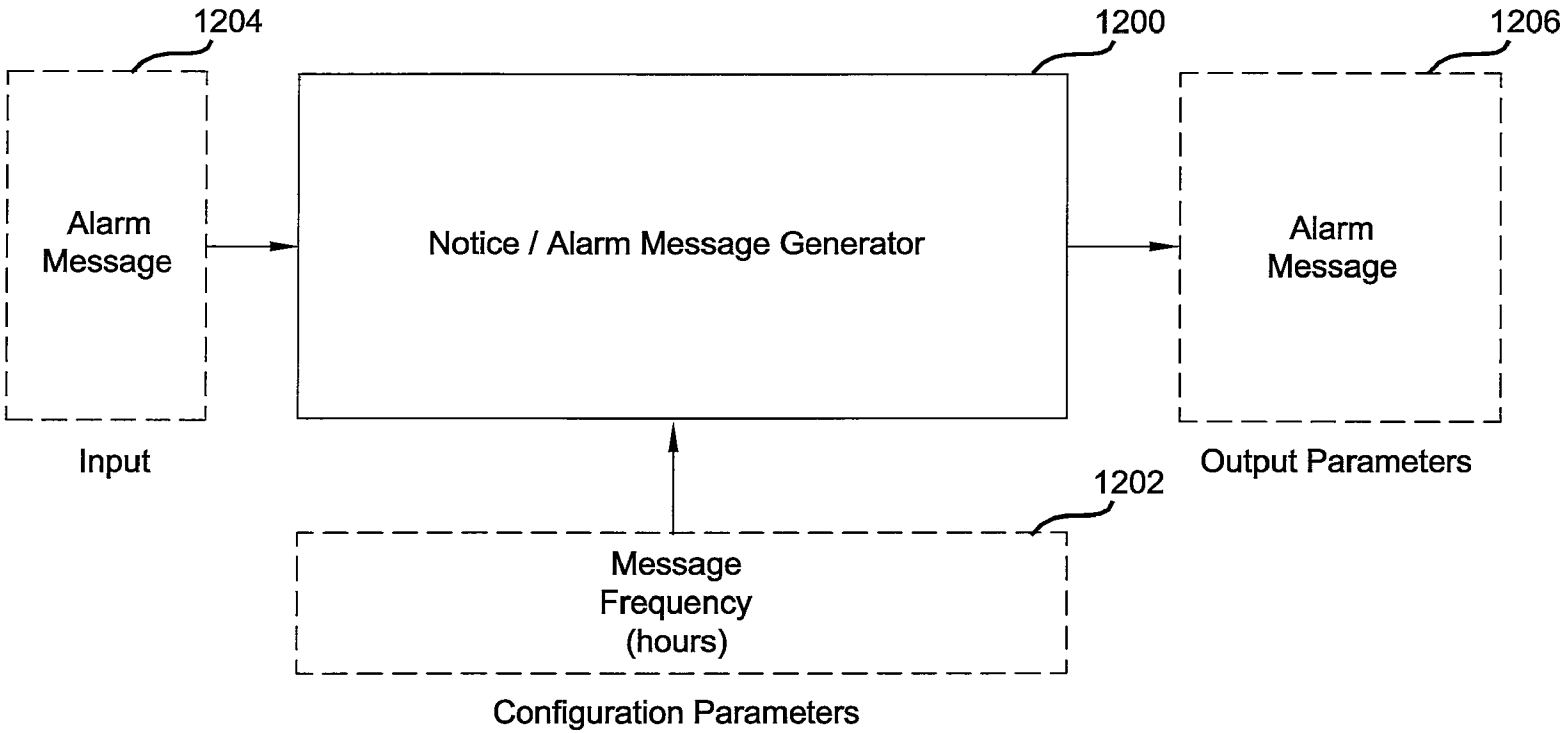
FIG. 12 is a block diagram illustrating configuration and output parameters of a recurring alarm algorithm.

Referring now to FIG. 12, a block diagram schematically illustrates the recurring notice or alarm message algorithm. The recurring notice or alarm message algorithm monitors the state of signals generated by the various algorithms described herein. Some signals remain in the alarm state for a protracted period of time until the corresponding issue is resolved. As a result, an alarm message that is initially generated as the initial alarm occurs may be overlooked later. The recurring notice/alarm message algorithm generates the alarm message at a configured frequency. The alarm message is continuously regenerated until the alarm condition is resolved.

The recurring notice or alarm message algorithm includes a notice/alarm message generator 1200, configuration parameters 1202, input parameters 1204 and output parameters 1206. The configuration parameters 1202 include message frequency. The input 1204 includes a notice/alarm message and the output parameters 1206 include a regenerated notice/alarm message. The notice/alarm generator 1200 regenerates the input alarm message at the indicated frequency. Once the notice/alarm condition is resolved, the input 1204 will indicate as such and regeneration of the notice/alarm message terminates.

Figure 13:
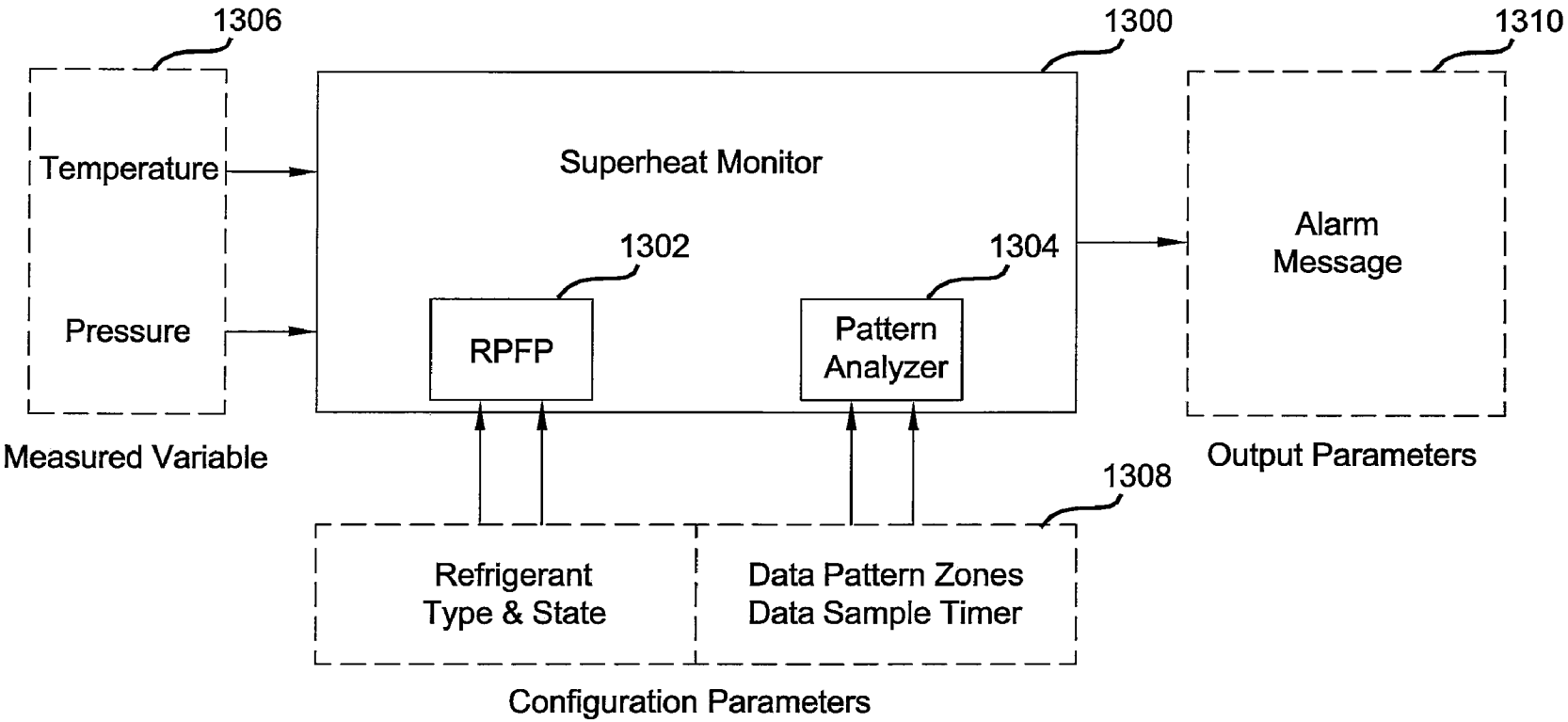
FIG. 13 is a block diagram illustrating configuration and output parameters of a superheat monitor algorithm.
Figure 14:
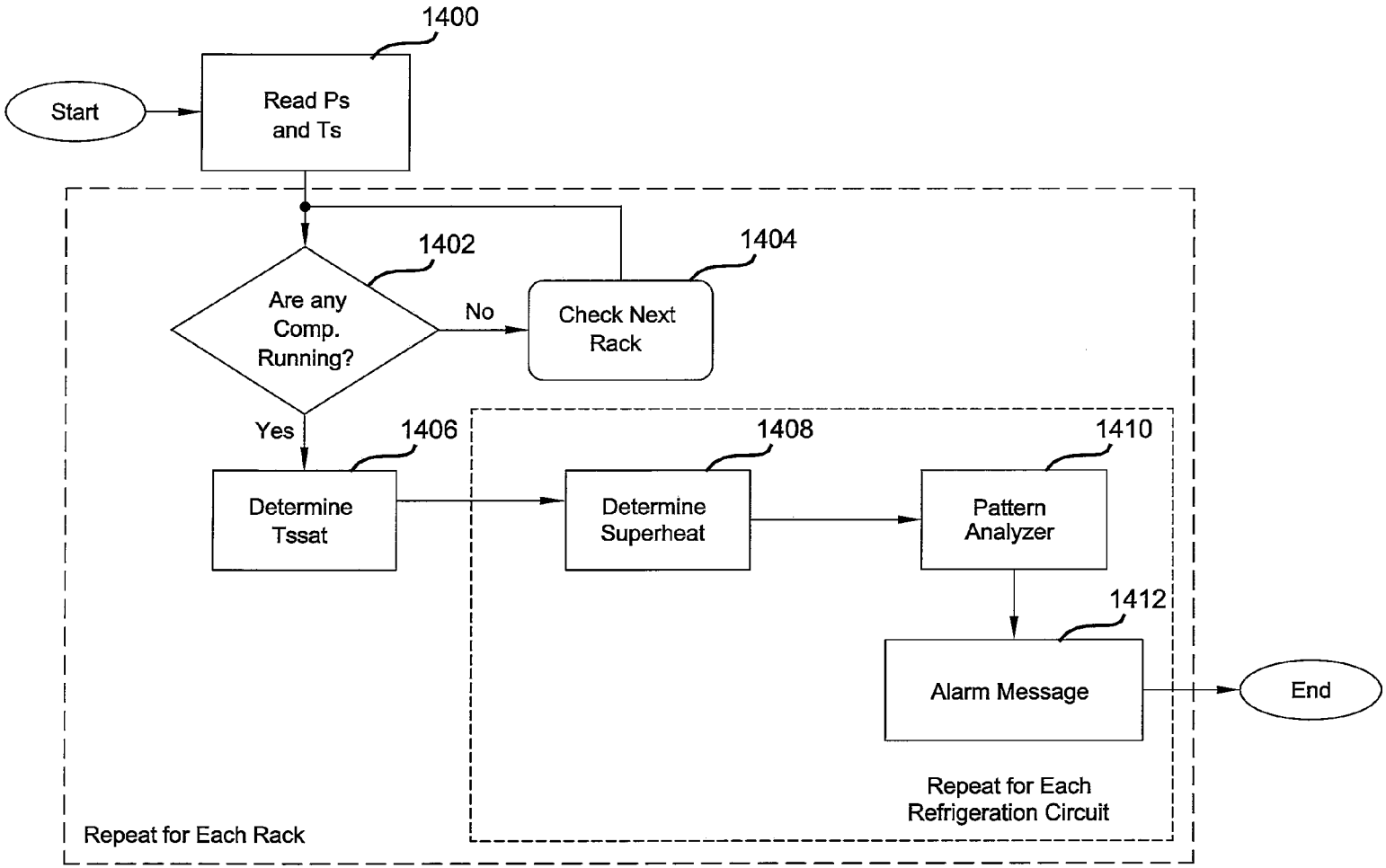
FIG. 14 is a flowchart illustrating a suction floodback alert algorithm.
Figure 15:
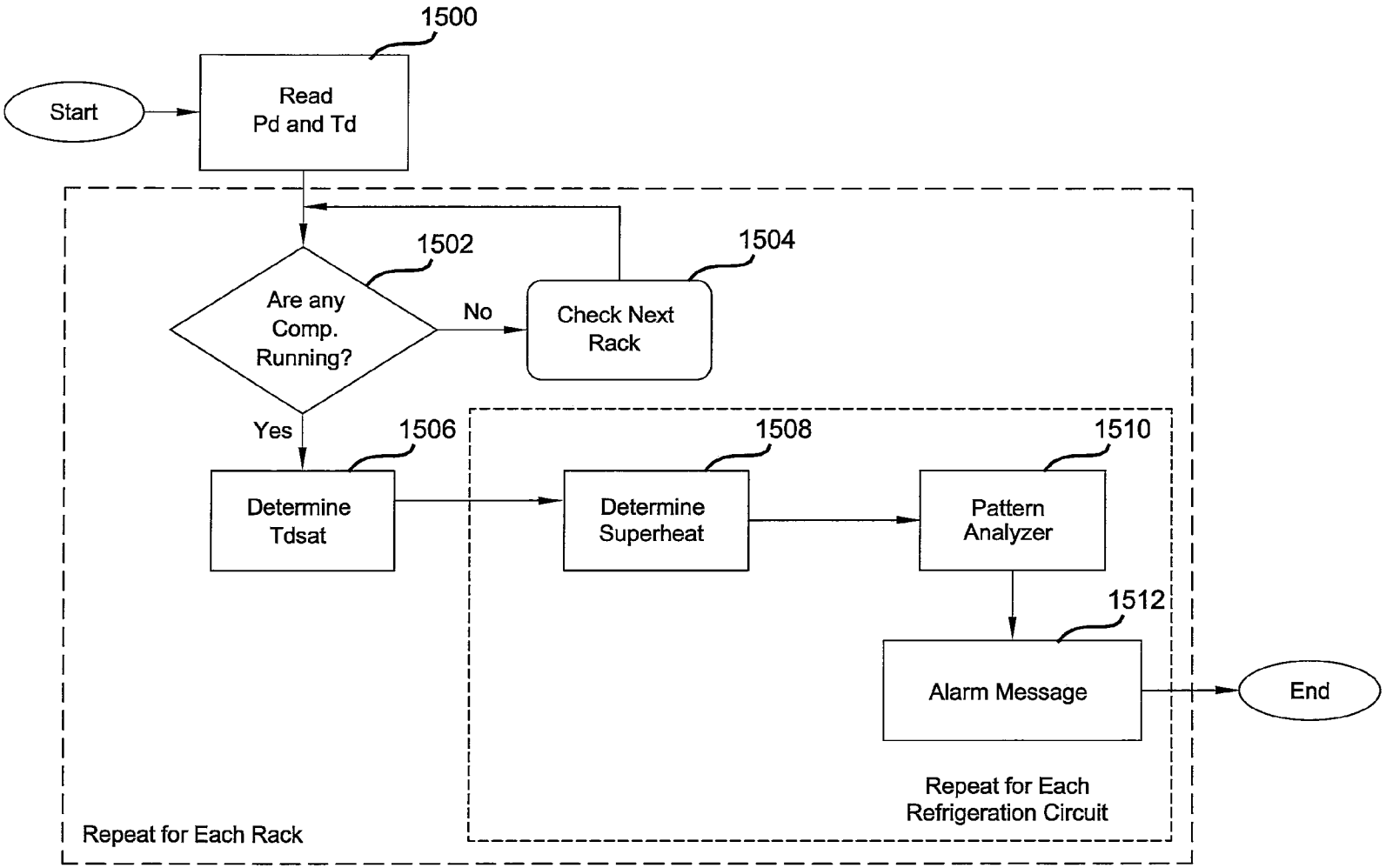
FIG. 15 is a flowchart illustrating a discharge floodback alert algorithm.

Referring now to FIGS. 13 through 15, the floodback alert algorithm is described in detail. Liquid refrigerant floodback occurs when liquid refrigerant reverse migrates through the refrigeration system 100 from the evaporator through to the compressor 102. The floodback alert algorithm monitors the superheat conditions of the refrigeration circuits A, B, C, D and both the compressor suction/discharge. The superheat is filtered through a pattern analyzer and an alarm is generated if the filtered superheat falls outside of a specified range. Superheat signals outside of the specified range indicate a floodback event. In the case where multiple floodback events are indicated, a severe floodback alarm is generated.

The saturated vapor temperature for the compressor suction is calculated from the suction pressure. The superheat is calculated for each refrigeration and compressor by subtracting the return temperature from the saturated vapor temperature. Similarly, assuming a saturated liquid, the superheat for each compressor discharge is calculated by subtracting the compressor discharge temperature from the discharge saturated liquid temperature.

FIG. 13 provides a schematic illustration of a superheat monitor block 1300 that includes an RPFP module 1302 and a pattern analyzer module 1304. Measured variables 1306 include temperature and pressure and are input to the superheat monitor 1300. Configuration parameters 1308 include refrigerant type and state, data pattern zones and a data sample timer. The refrigerant type and state are input to the RPFP module 1302. The data pattern zones and data sample timer are input to the pattern analyzer 1304. The RPFP module 1302 determines the saturated vapor temperature based on the refrigerant type and state and the pressure. The superheat monitor 1300 determines the superheat, which is filtered through the pattern analyzer 1304. Output parameters 1310 include an alarm message that is generated by the superheat monitor 1300 based on the filtered superheat signal.

Referring now to FIG. 14, the floodback alert algorithm for the suction side will be described in more detail. In step 1400, $P_s$ and $T_s$ are measured by the suction temperature and pressure sensors 120,118. In step 1402 it is determined whether any compressors for the current rack are running. If no compressors are running, the next rack is checked in step 1404. If a compressor is running, the suction saturation temperature ($T_{SSAT}$) is determined based on $P_s$ in step 1406. The superheat is determined based on $T_{SSAT}$ and $T_s$ in step 1408. The superheat is filtered by the pattern analyzer in step 1410. If appropriate, an alarm message is generated in step 1412 and the algorithm ends. Steps 1402 through 1412 are repeated for each rack and steps 1408 through 1412 are repeated for each refrigeration circuit.

Referring now to FIG. 15, the floodback alert algorithm is illustrated for the discharge side. In step 1500, $P_d$ and $T_d$ are measured by the discharge temperature and pressure sensors. In step 1502 it is determined whether any compressors for the current rack are running. If no compressors are running, the next rack is checked in step 1504. If a compressor is running, the discharge saturation temperature ($T_{DSAT}$) is determined based on $P_d$ in step 1506. The superheat is determined based on $T_{DSAT}$ and $T_d$ in step 1508. The superheat is filtered by the pattern analyzer in step 1510. If appropriate, an alarm message is generated in step 1512 and the algorithm ends. Steps 1502 through 1512 are repeated for each rack and steps 1508 through 1512 are repeated for each refrigeration circuit.

Alternative embodiments of the floodback alert algorithm will be described in detail. In a first alternative embodiment, the superheat is compared to a threshold value. If the superheat is greater than or equal to the threshold value then a floodback condition exists. In the event of a floodback condition an alert message is generated.

More particularly, $T_{SAT}$ is determined by referencing a look-up table using $P_s$ and the refrigerant type. An alarm value (A) and time delay (t) are also provided as presets and may be user selected. An exemplary alarm value is 15° F. The suction superheat ($SH_{SUC}$) is determined by the difference between $T_s$ and $T_{SAT}$. An alarm will be signaled if $SH_{SUC}$ is greater than the alarm value for a time period longer than the time delay. This is governed by the following logic:

If $SH_{SUC}$>A and time>t, then alarm

In another alternative embodiment, the rate of change of $T_s$ is monitored. That is to say, the temperature signal from the temperature sensor 118 is monitored over a period of time. The rate of change is compared to a threshold rate of change. If the rate of change of $T_s$ is greater than or equal to the threshold rate of change, a floodback condition exists.

The contactor cycling count algorithm monitors the cycling of the various contacts in the refrigeration system 100. The counting mechanism can be one of an internal or an external nature. With respect to internal counting, the refrigeration controller 140 can perform the counting function based on its command signals to operate the various equipment. The refrigeration controller 140 monitors the number of times the particular contact has been cycled ($N_{CYCLE}$) for a given load. Alternatively, with respect to external counting, a separate current sensor or auxiliary contact can be used to determine $N_{CYCLE}$. If $N_{CYCLE}$ per hour for the given load is greater than a threshold number of cycles per hour ($N_{THRESH}$), an alarm is initiated. The value of $N_{THRESH}$ is based on the function of the particular contactor.

Additionally, $N_{CYCLE}$ can be used to predict when maintenance of the associated equipment or contactor should be scheduled. In one example, $N_{THRESH}$ is associated with the number of cycles after which maintenance is typically required. Therefore, the alarm indicates maintenance is required on the particular piece of equipment the contact is associated with. Alternatively, $N_{CYCLE}$ can be tracked over time to estimate a point in time when it will achieve $N_{THRESH}$. A predicative alarm is provided indicating a future point in time when maintenance will be required.

The cycle count for multiple contactors can be monitored. A group alarm can be provided to indicate predicted maintenance requirements for a group of equipment. The groups include equipment whose $N_{CYCLE}$ count will achieve their respective $N_{THRESH}$'s within approximately the same time frame. In this manner, the number of maintenance calls is reduced by performing multiple maintenance tasks during a single visit of maintenance personnel.

Figure 16:
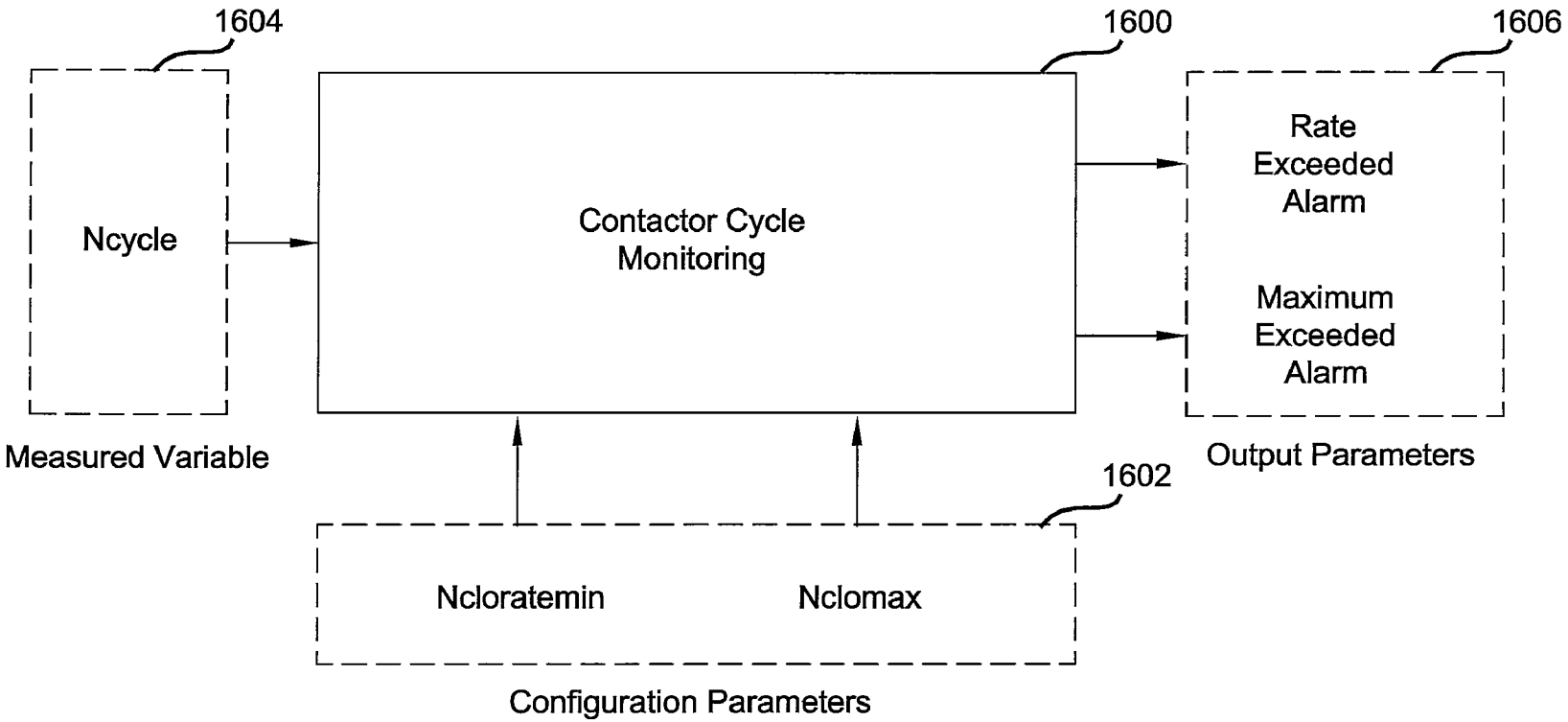
FIG. 16 is a block diagram illustrating configuration and output parameters of a contactor cycle monitoring algorithm.
Figure 17:
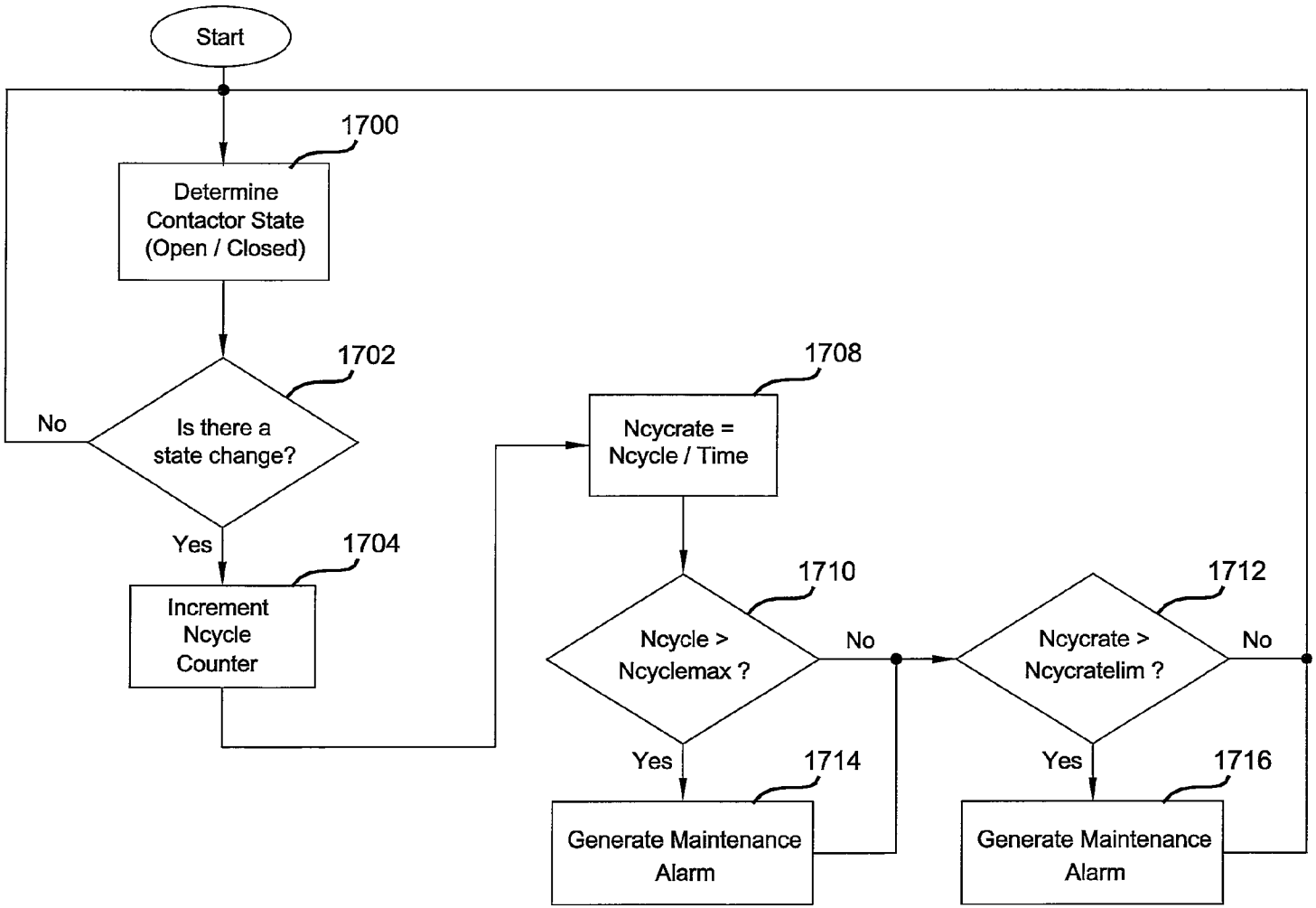
FIG. 17 is a flowchart illustrating the contactor cycle monitoring algorithm.

Referring now to FIGS. 16 and 17, the contactor cycling count algorithm will be described with respect to the compressor motor. A contactor cycle monitoring block 1600 includes a measured variable input 1602 and configuration parameter inputs 1604. The contactor cycle monitoring block 1600 processes the measured variable 1602 and the configuration parameters 1604 and generates output parameters 1606. The measured variable includes $N_{CYCLE}$ for the particular compressor and the configuration parameters include a cycle rate limit ($N_{CYCRATELIM}$) and a cycle maximum ($N_{CYCMAX}$). The output parameters include a rate exceeded alarm and a maximum exceeded alarm. The rate exceeded alarm is generated when the rate at which the contactor is cycled ($N_{CYCRATE}$) exceeds $N_{CYCRATELIM}$. Similarly, the maximum exceeded alarm is generated when $N_{CYCLE}$ exceeds $N_{CYCMAX}$.

FIG. 17 illustrates steps of the contactor cycling count algorithm. In step 1700 the contactor state (i.e., open or closed) is determined. In step 1702, it is determined whether a state change has occurred. If a state change has not occurred, the algorithm loops back to step 1700. If a state change has occurred, $N_{CYCLE}$ is incremented in step 1704.

$N_{CYCRATELIM}$ is determined in step 1708 by dividing $N_{CYCLE}$ by the time over which the closures occurred.

In step 1710, the algorithm determines whether $N_{CYCLE}$ exceeds $N_{CYCMAX}$. If $N_{CYCLE}$ does not exceed $N_{CYCLEMAX}$, the algorithm continues in step 1712. If $N_{CYCLE}$ exceeds $N_{CYCMAX}$, an alarm is generated in step 1714 and the algorithm continues in step 1712. In step 1712, the algorithm determines whether $N_{CYCRATE}$ exceeds $N_{CYCRATELIM}$. If $N_{CYCRATE}$ does not exceed $N_{CYCRATELIM}$, the algorithm loops back to step 1700. If $N_{CYCRATE}$ exceeds $N_{CYCRATELIM}$, an alarm is generated in step 1716 and the algorithm loops back to step 1700.

The compressor performance algorithm compares a theoretical compressor energy requirement ($E_{THEO}$) to an actual measurement of the compressor's energy consumption ($E_{ACT}$). $E_{THEO}$ is determined based on a model of the compressor. $E_{ACT}$ is directly measured from the energy sensors 150. A difference between $E_{THEO}$ and $E_{ACT}$ is determined and compared to a threshold value ($E_{THRESH}$). If the absolute value of the difference is greater than $E_{THRESH}$ an alarm is initiated indicating a fault in compressor performance.

Figure 18:
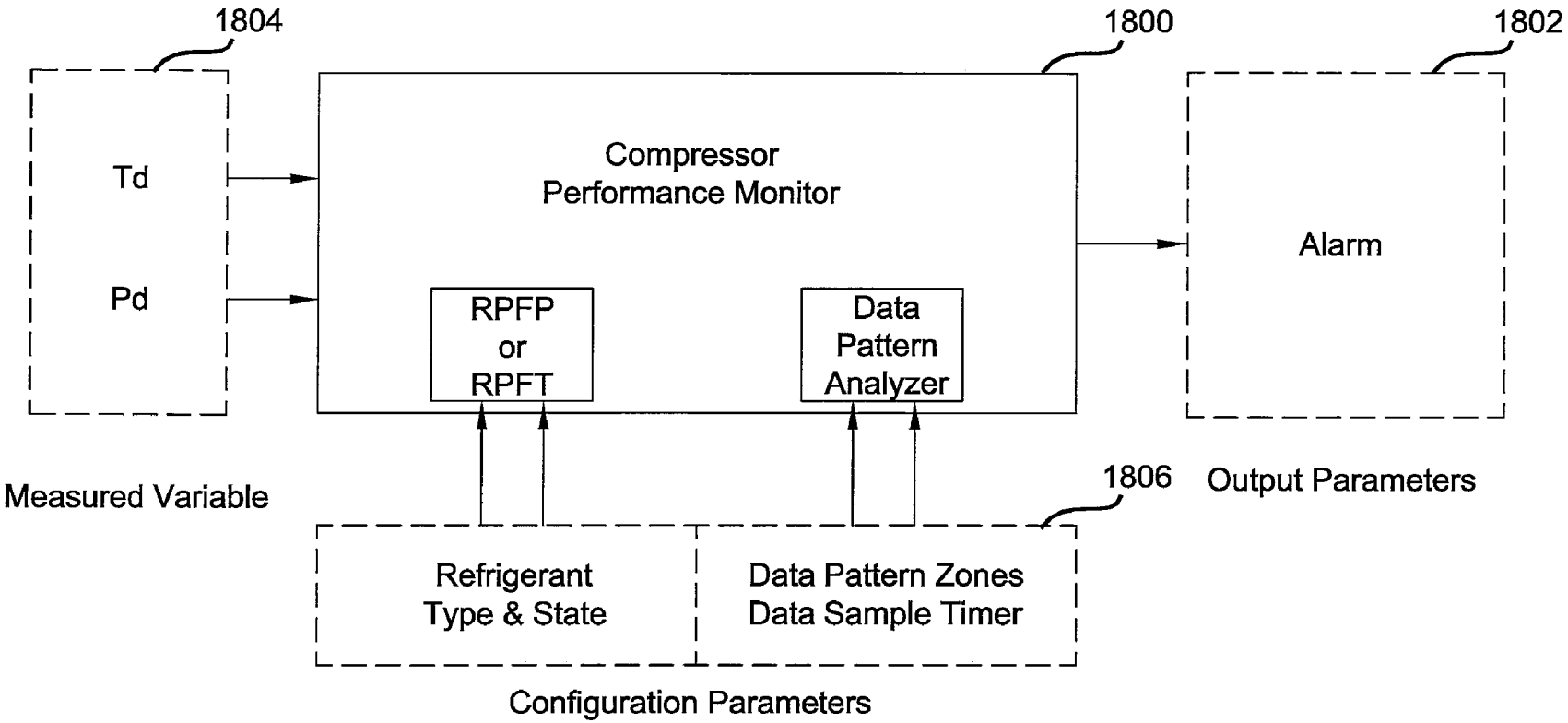
FIG. 18 is a block diagram illustrating configuration and output parameters of a compressor performance monitor.
Figure 19:
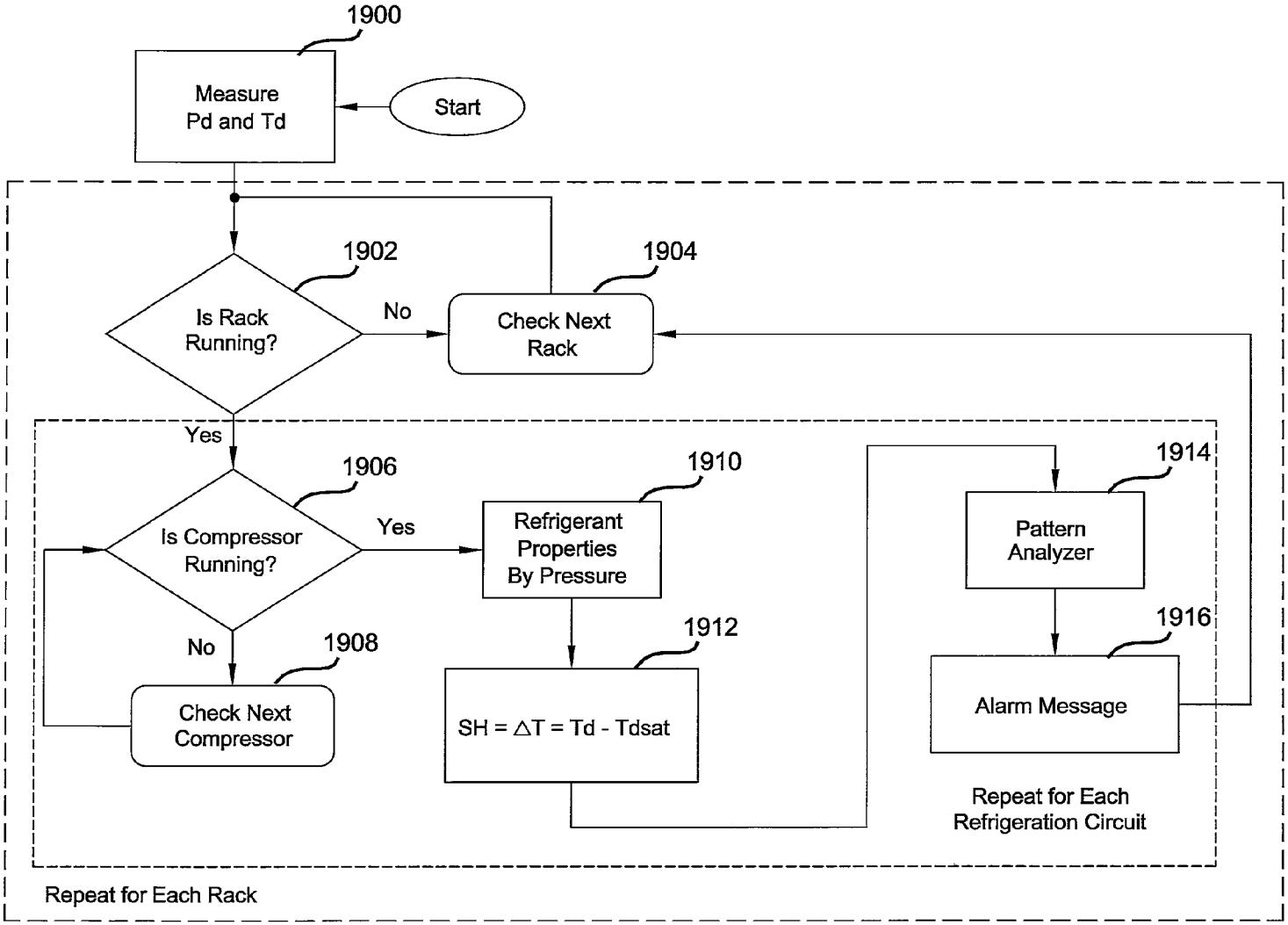
FIG. 19 is a flowchart illustrating a compressor fault detection algorithm.

Referring now to FIGS. 18 and 19, compressor fault detection algorithm will be described in detail. In general, the compressor fault detection algorithm monitors $T_d$ and determines whether the compressor is operating properly based thereon. $T_d$ reflects the latent heat absorbed in the evaporator, evaporator superheat, suction line heat gain, heat of compression, and compressor motor-generated heat. All of this heat is accumulated at the compressor discharge and must be removed. High compressor $T_d$'s result in lubricant breakdown, worn rings, and acid formation, all of which shorten the compressor lifespan. This condition can indicate a variety of problems including, but not limited to damaged compressor valves, partial motor winding shorts, excess compressor wear, piston failure and high compression ratios. High compression ratios can be caused by either low $P_s$, high head pressure, or a combination of the two. The higher the compression ratio, the higher the $T_d$ will be at the compressor. This is due to heat of compression generated when the gasses are compressed through a greater pressure range.

For each compressor rack with at least one compressor running the discharge saturation temperature ($T_{DSAT}$) is calculated based on $P_d$. For each compressor running in the rack SH is calculated by subtracting $T_{DSAT}$ from $T_d$. The SH data once each minute for 30 minutes using the pattern analyzer. If the accumulated data indicates an abnormal condition an alarm is generated. Alternatively, $T_s$ and $P_s$ can be monitored and compared to compressor performance curves. For this, a block similar to RPFP and RPFT can be created to perform the performance curve calculations for comparison. Specific deviations from the performance curve would generate maintenance notices.

With particular reference to FIG. 18, a compressor performance monitor block 1800 generates an output parameter 1802 based on measured variables 1804 and configuration parameters 1806. The output parameter 1802 includes an alarm and the measured variable includes $T_d$ and $P_d$. The configuration parameters include refrigerant type and state and data pattern zones and a data sample timer. The compressor performance monitor block 1800 determines SH and processes SH through the data pattern analyzer and generates the alarm if required.

Referring now to FIG. 19, the compressor fault detection algorithm is illustrated. In step 1900, $P_d$ and $T_d$ are measured by the discharge temperature and pressure sensors. In step 1902, it is determined whether the current rack is running. If the current rack is not running, the algorithm moves to the next rack in step 1904. In step 1906 and 1908, it is determined whether each compressor in the rack is running. In step 1910, $T_{DSAT}$ is determined for the running compressor based on $P_d$. The superheat is determined based on $T_{DSAT}$ and $T_d$ in step 1912. The superheat is filtered by the pattern analyzer in step 1914. If appropriate, an alarm message is generated in step 1916 and the algorithm loops back to step 1904. Steps 1902 through 1916 are repeated for each rack and steps 1906 through 1916 are repeated for each refrigeration circuit.

In an alternative embodiment, the compressor fault detection algorithm compares the actual $T_d$ to a calculated discharge temperature ($T_{dcalc}$). $T_d$ is measured by the temperature sensors 114 associated with the discharge of each compressor 102. Measurements are taken at approximately 10 second intervals while the compressors 102 are running. $T_{dcalc}$ is calculated as a function of the refrigerant type, $P_d$, suction pressure ($P_s$) and suction temperature ($T_s$), each of which are measured by the associated sensors described above. An alarm value (A) and time delay (t) are also provided as presets and may be user selected. An alarm is signaled if the difference between the actual and calculated discharge temperature is greater than the alarm value for a time period longer than the time delay. This is governed by the following logic:

If $(T_d - T_{dcalc}) > A$ and time>t, then alarm

Dirt and debris gradually builds up on the condenser coil and condenser fans can fail, impairing condenser performance. As these events occur, condenser performance degrades, inhibiting heat transfer to the atmosphere. The condenser performance algorithm is provided to determine whether the condenser 126 is dirty, which would result in a loss of energy efficiency or more serious system problems. Trend data is analyzed over a specified time period (e.g., several days). More specifically, the average difference between the ambient temperature ($T_a$) and the condensing temperature ($T_{COND}$) is determined over the time period. If the average difference is greater than a threshold ($T_{THRESH}$) (e.g., 25° F.) a dirty condenser situation is indicated and a maintenance alarm is initiated. $T_a$ is directly measured from the temperature sensor 128.

Figure 20:
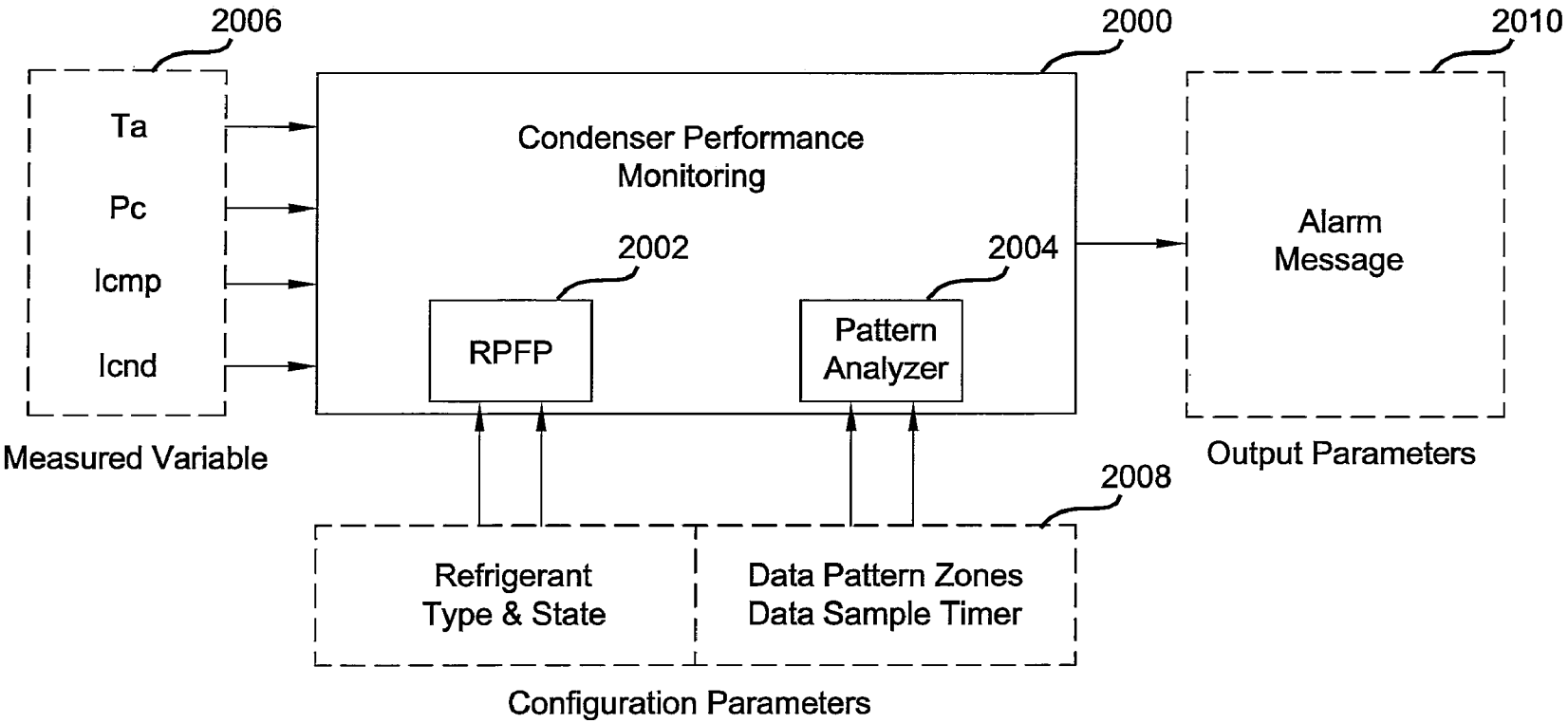
FIG. 20 is a block diagram illustrating configuration and output parameters of a condenser performance monitor.
Figure 21:
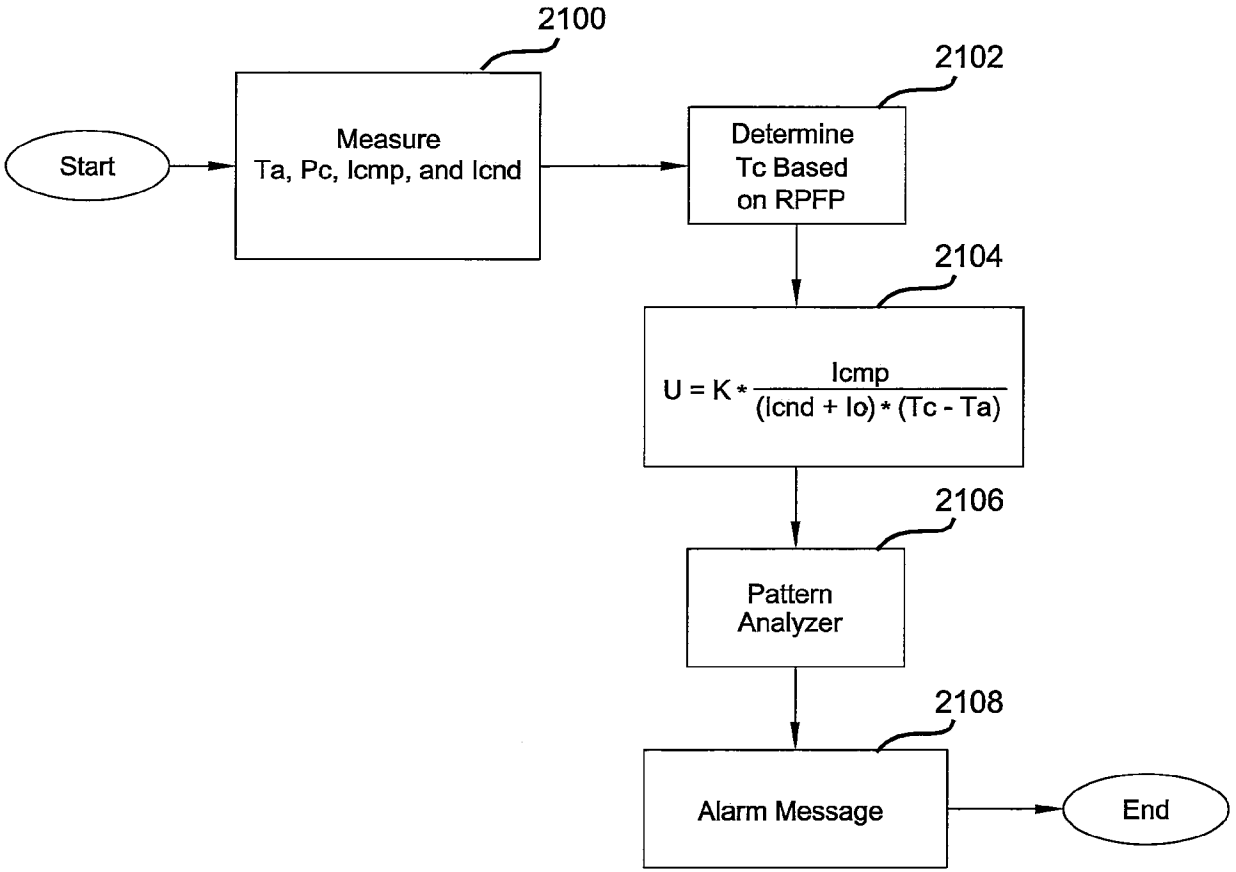
FIG. 21 is a flowchart illustrating a condenser performance algorithm.

Referring specifically to FIGS. 20 and 21, another alternative condenser performance algorithm will be described in detail. As illustrated in FIG. 20, a condenser performance monitor block 2000 includes an RPFP module 2002 and a pattern analyzer module 2004. The condenser performance monitor block 2000 receives measured variables 2006 and configuration parameters 2008 and generates output parameters 2010 based thereon. The measured variables include $T_a$, $P_c$, $I_{cmp}$ and a condenser load ($I_{cnd}$). The configuration parameters 2008 include refrigerant type and state, data pattern zones and a data sampler timer. The output parameters 2010 include an alarm message.

With particular reference to FIG. 21, $T_a$, $P_c$, $I_{cmp}$ and $I_{cnd}$ are all measured by their respective sensors in step 2100. In step 2102, $T_c$ is determined based on $P_c$ using RPFP, as discussed in detail above. In step 2104, condenser capacity (U) is determined according to the following equation:

$$U = K\frac{I_{CMP}}{(I_{CND} + I_0)(T_c - T_a)}$$

where K is a system constant and $I_o$ is a calibration value. For example, $I_o$ can be set equal to 10% of the current consumption when all condenser fans are on. In step 2106, U is processed through the pattern analyzer and an alarm maybe generated in step 2108 based on the results. As U varies from ideal, condenser performance may be impaired and an alarm message will be generated.

The defrost abnormality algorithm learns the behavior of defrost activity in the refrigeration circuits A, B, C, D. The learned or average defrost behavior is compared to current or past defrost conditions. More specifically, the defrost time ($t_{DEF}$), maximum defrost time ($t_{DEFMAX}$) and defrost termination temperature ($T_{TERM}$) are monitored. If $t_{DEF}$ achieves $t_{DEFMAX}$ for a number of consecutive defrost cycles ($N_{DEF}$) (e.g., 5 cycles) and the particular case or circuit is set to terminate defrost at $T_{TERM}$, an abnormal defrost situation is indicated. An alarm is initiated accordingly. The defrost abnormality algorithm also monitors $T_{TERM}$ across cases within a circuit to isolate cases having the highest $T_{TERM}$.

The case discharge versus product temperature algorithm compares the air discharge temperature ($T_{DISCHARGE}$) to the case's set point temperature ($T_{SETPOINT}$) and the product temperature ($T_{PROD}$) to $T_{DISCHARGE}$. The case temperature ($T_{CASE}$) is also monitored. If $T_{DISCHARGE}$ is equal to $T_{SETPOINT}$, and $T_{PROD}$ is greater than $T_{CASE}$ plus a tolerance temperature ($T_{TOL}$) a problem with the case is indicated. An alarm is initiated accordingly.

Refrigerant level within the refrigeration system 100 is a function of refrigeration load, ambient temperatures, defrost status, heat reclaim status and refrigerant charge. A reservoir level indicator (not shown) reads accurately when the system is running and stable and it varies with the cooling load. When the system is turned off, refrigerant pools in the coldest parts of the system and the level indicator may provide a false reading. The refrigerant loss detection algorithm determines whether there is leakage in the refrigeration system 100. The liquid refrigerant level in an optional receiver (not shown) is monitored. The receiver would be disposed between the condenser 126 and the individual circuits A, B, C, D. If the liquid refrigerant level in the receiver drops below a threshold level, a loss of refrigerant is indicated and an alarm is initiated.

Figure 22:
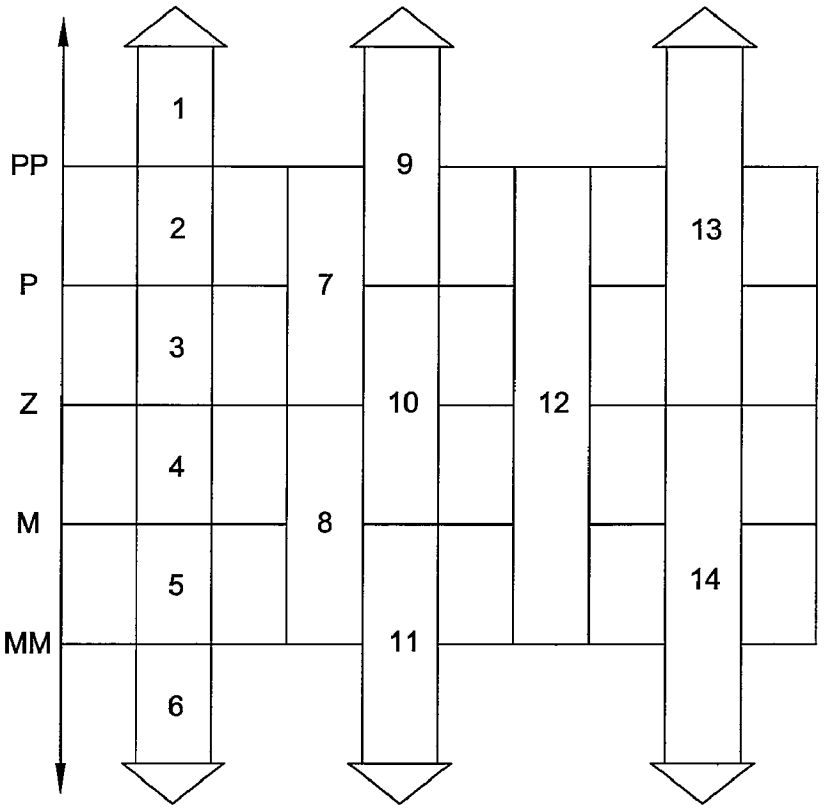
FIG. 22 is a graph illustrating pattern bands of the pattern recognition algorithm
Figure 23:
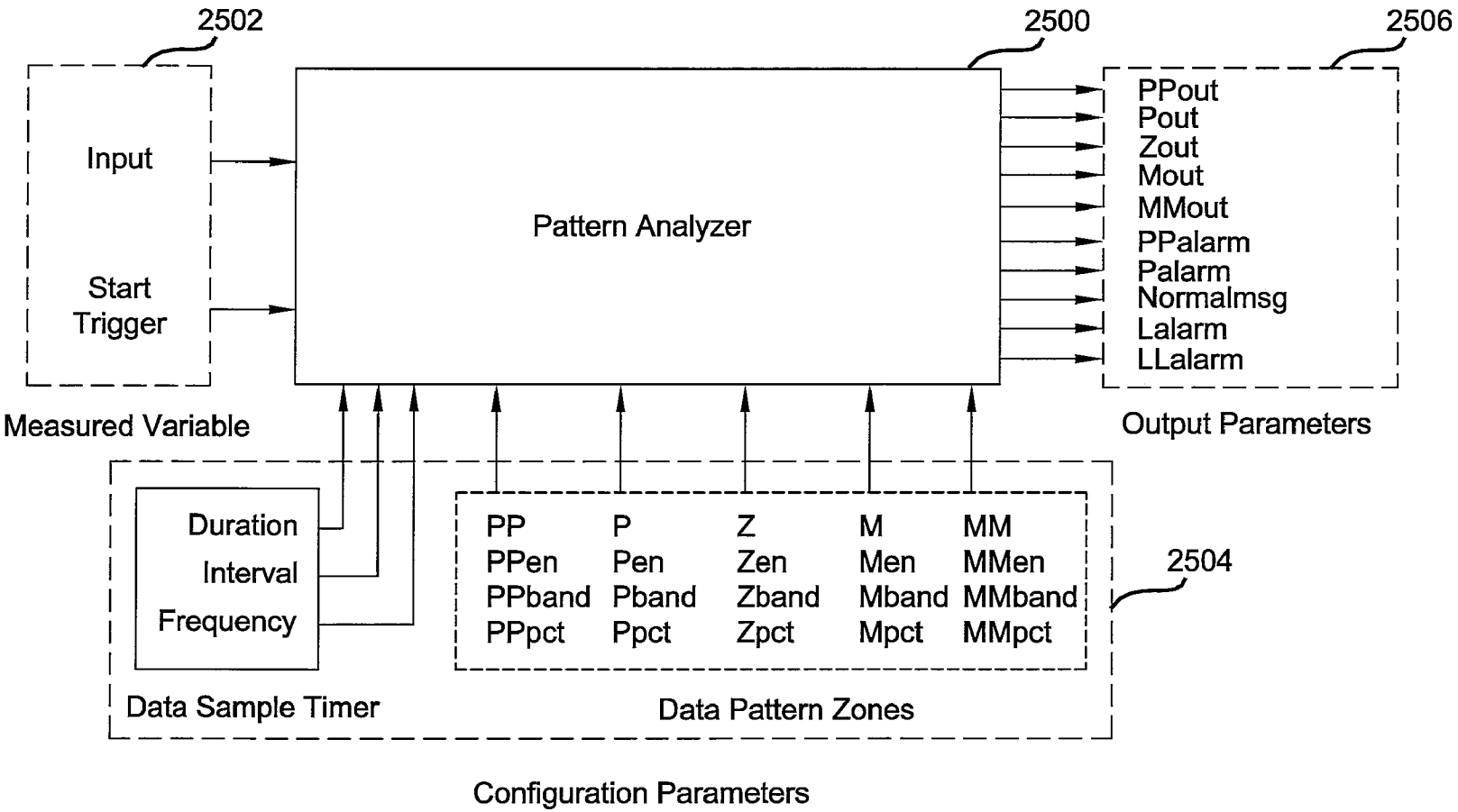
FIG. 23 is a block diagram illustrating configuration and output parameters of a pattern analyzer.
Figure 24:
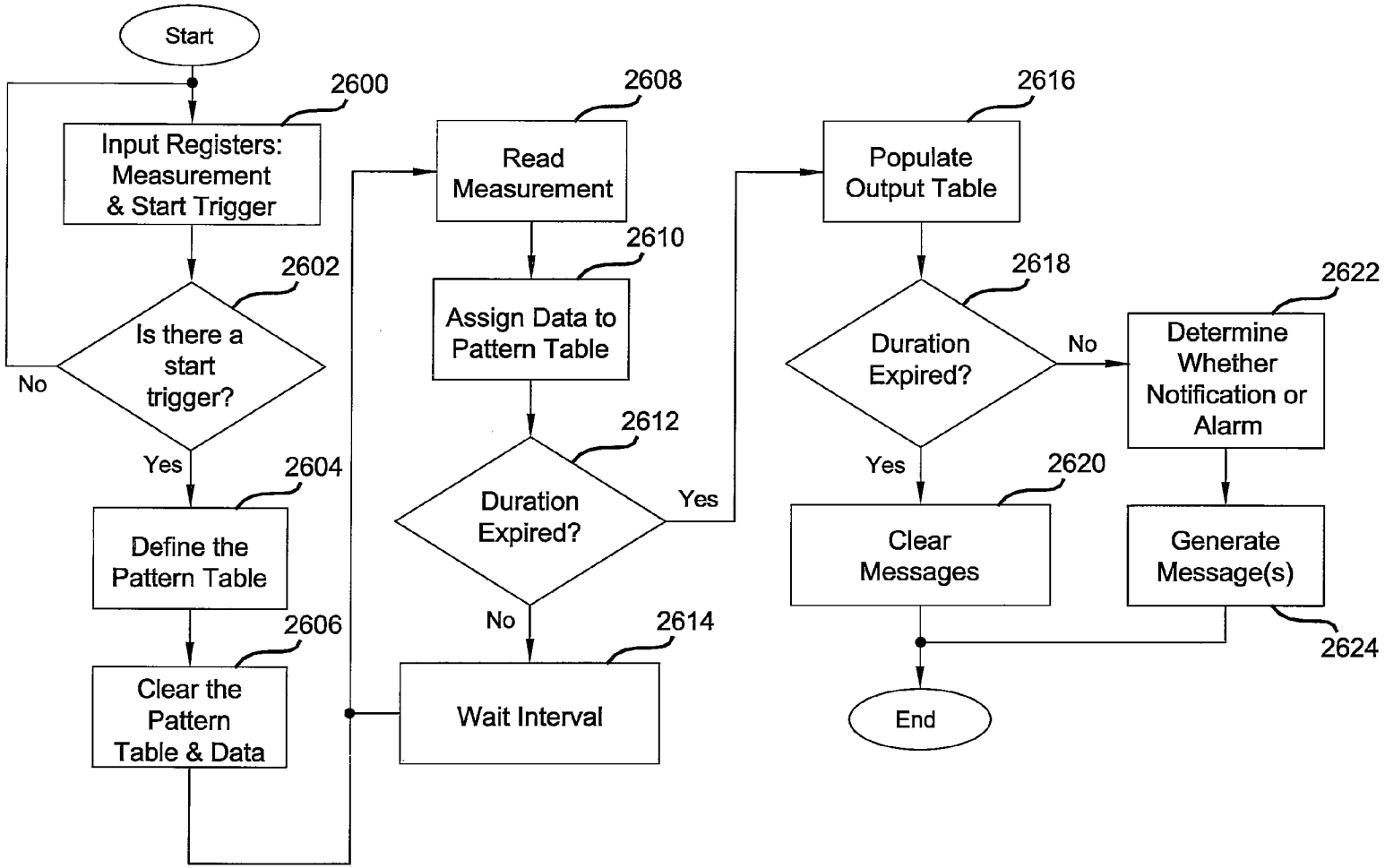
FIG. 24 is a flowchart illustrating a pattern recognition algorithm.

Referring now to FIGS. 22 through 24, the data pattern recognition algorithm monitors inputs such as $T_{CASE}$, $T_{PROD}$, $P_s$ and $P_d$. The algorithm includes a data table (see FIG. 22) having multiple bands whose upper and lower limits are defined by configuration parameters. A particular input is measured at a configured frequency (e.g., every minute, hour, day, etc.). as the input value changes, the algorithm determines within which band the value lies and increments a counter for that band. After the input has been monitored for a specified time period (e.g., a day, a week, a month, etc.) alarms are generated based on the band populations. The bands are defined by various boundaries including a high positive (PP) boundary, a positive (P) boundary, a zero (Z) boundary, a minus (M) boundary and a high minus (MM) boundary. The number of bands and the boundaries thereof are determined based on the particular refrigeration system operating parameter to be monitored. For each reading a corresponding band is populated. If the population of a particular band exceeds an alarm limit, a corresponding alarm is generated.

Referring now to FIG. 23, a pattern analyzer block 2500 receives measured variables 2502, configuration parameters 2504 and generates output parameters 2506 based thereon. The measured variables 2502 include an input (e.g., $T_{CASE}$, $T_{PROD}$, $P_s$ and $P_d$). The configuration parameters 2504 include a data sample timer and data pattern zone information. The data sample timer includes a duration, an interval and a frequency. The data pattern zone information defines the bands and which bands are to be enabled. For example, the data pattern zone information provides the boundary values (e.g., PP) band enablement (e.g., PPen), band value (e.g., PPband) and alarm limit (e.g., PPpct).

Referring now to FIG. 24, input registers are set for measurement and start trigger in step 2600. In step 2602, the algorithm determines whether the start trigger is present. If the start trigger is not present, the algorithm loops back to step 2600. If the start trigger is present, the pattern table is defined in step 2604 based on the data pattern bands. In step 2606, the pattern table is cleared. In step 2608, the measurement is read and the measurement data is assigned to the pattern table in step 2610.

In step 2612, the algorithm determines whether the duration has expired. If the duration has not yet expired, the algorithm waits for the defined interval in step 2614 and loops back to step 2608. If the duration has expired, the algorithm populates the output table in step 2616. In step 2618, the algorithm determines whether the results are normal. In other words, the algorithm determines whether the population of a each band is below the alarm limit for that band. If the results are normal, messages are cleared in step 2620 and the algorithm ends. If the results are not normal, the algorithm determines whether to generate a notification or an alarm in step 2622. In step 2624, the alarm or notification message(s) is/are generated and the algorithm ends.

The foregoing description has been provided for purposes of illustration and description. It is not intended to be exhaustive or to limit the present teachings. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the present teachings, and all such modifications are intended to be included within the scope of the present teachings.

What is claimed is:

1. A system comprising:

a compressor temperature sensor that generates a compressor discharge temperature signal corresponding to a compressor of a refrigeration system;

a compressor pressure sensor that generates a compressor discharge pressure signal corresponding to said compressor;

a controller processing said signals over a predetermined time period, said processing including receiving a refrigerant type indicating a particular type of refrigerant in the refrigeration system, determining a discharge saturation temperature based on said compressor discharge pressure signal and said refrigerant type using a lookup table linking refrigerant types and discharge pressures to predetermined discharge saturation suction temperatures, calculating compressor superheat data based on said compressor discharge temperature signal and said discharge saturation temperature, accumulating said compressor superheat data over said predetermined time period, and comparing said accumulated compressor superheat data to a predetermined threshold, said controller generating an alarm indicating a compressor fault based on said comparing.

2. The system of claim 1, wherein said processing of said signals includes determining whether each of said signals is within a useful range, determining whether each of said signals is dynamic and determining whether each of said signals is valid.

3. The system of claim 1, wherein said controller communicates said alarm over a communication network to a remote processing center.

4. The system of claim 1, wherein said controller observes a pattern of said compressor superheat data to determine whether a floodback event has occurred.

5. The system of claim 1, wherein said controller accumulates compressor superheat data for each compressor of a plurality of compressors positioned within a compressor rack, compares said accumulated compressor superheat data for said each compressor, and generates an alarm indicating a compressor fault for each compressor positioned within said compressor rack based on said comparing.

6. The system of claim 1, wherein said controller determines a plurality of bands that define ranges associated with each of said signals and populates each band based on values of said signals that are observed over said predetermined time period.

7. The system of claim 6, wherein said alarm is generated when a population of a particular band exceeds a threshold associated with said particular band.

8. A non-transitory computer readable medium having machine executable instructions stored thereon for execution by a processor to perform a method comprising:

receiving a compressor discharge temperature signal from a compressor temperature sensor corresponding to a compressor of a refrigeration system;

receiving a compressor discharge pressure signal from a compressor pressure sensor corresponding to said compressor;

processing said signals over a predetermined time period, said processing including receiving a refrigerant type indicating a particular type of refrigerant in the refrigeration system, determining a discharge saturation temperature based on said compressor discharge pressure signal and said refrigerant type using a lookup table linking refrigerant types and discharge pressures to predetermined discharge saturation suction temperature, calculating compressor superheat data based on said compressor discharge temperature signal and said discharge saturation temperature, accumulating said compressor superheat data over said predetermined time period, and comparing said accumulated compressor superheat data to a predetermined threshold;

generating an alarm indicating a compressor fault based on said comparing.

9. The non-transitory computer readable medium recited by claim 8, the method further comprising determining whether each of said signals is within a useful range, determining whether each of said signals is dynamic and determining whether each of said signals is valid.

10. The non-transitory computer readable medium recited by claim 8, the method further comprising communicating said alarm over a communication network to a remote processing center.

11. The non-transitory computer readable medium recited by claim 8, the method further comprising observing a pattern of said compressor superheat data to determine whether a floodback event has occurred.

12. The non-transitory computer readable medium recited by claim 8, the method further comprising accumulating compressor superheat data for each compressor of a plurality of compressors positioned within a compressor rack, comparing said accumulated compressor superheat data for said each compressor, and generating an alarm indicating a compressor fault for each compressor positioned within said compressor rack based on said comparing.

13. The non-transitory computer readable medium recited by claim 8, the method further comprising:

determining a plurality of bands that define ranges associated with each of said signals; and populating each band based on values of said signals that are observed over said predetermined time period.

14. The non-transitory computer readable medium recited by claim 13, the method further comprising generating said alarm when a population of a particular band exceeds a threshold associated with said particular band.

* * * * *

UNITED STATES PATENT AND TRADEMARK OFFICE

CERTIFICATE OF CORRECTION

PATENT NO. : 7,845,179 B2
APPLICATION NO. : 12/327273
DATED : December 7, 2010
INVENTOR(S) : Abtar Singh et al.

It is certified that error appears in the above-identified patent and that said Letters Patent is hereby corrected as shown below:

| | |
|---|---|
| On the Title Page,<br>Item (75), Inventors, 2nd Inventor | "Matthews" should be --Mathews--. |
| Column 2, Line 59 | After "signals", insert --is valid--. |
| Column 4, Line 10 | After "algorithm", insert --;--. |
| Column 5, Line 21 | "on an off" should be --on and off--. |
| Column 6, Line 33 | "Foe example" should be --For example--. |
| Column 7, Line 19 | "a time A" should be --a time Δ--. |
| Column 13, Line 1 | "maybe" should be --may be--. |
| Column 13, Line 45 | "as" should be --As--. |
| Column 14, Line 19 | After "of", delete "a". |

Signed and Sealed this
Fourth Day of October, 2011

David J. Kappos

David J. Kappos
*Director of the United States Patent and Trademark Office*